US007086534B2

(12) United States Patent
Roesel et al.

(10) Patent No.: US 7,086,534 B2
(45) Date of Patent: Aug. 8, 2006

(54) SUSPENSION AND RETENTION PACKAGING STRUCTURES AND METHODS FOR FORMING SAME

(75) Inventors: Stephan Roesel, Oppenrod (DE); Christof Hammerschmidt, Wiesbaden (DE)

(73) Assignee: Sealed Air Verpackungen GmbH (DE)

( * ) Notice: Subject to any disclaimer, the term of this patent is extended or adjusted under 35 U.S.C. 154(b) by 263 days.

(21) Appl. No.: 10/348,467

(22) Filed: Jan. 21, 2003

(65) Prior Publication Data

US 2004/0140243 A1 Jul. 22, 2004

(51) Int. Cl.
*B65D 81/07* (2006.01)

(52) U.S. Cl. ..... 206/583; 206/591

(58) Field of Classification Search ..... 206/583
See application file for complete search history.

(56) References Cited

U.S. PATENT DOCUMENTS

| | | | | |
|---|---|---|---|---|
| 3,752,301 A | | 8/1973 | Bluemel | |
| 3,853,220 A | | 12/1974 | Luray | |
| 3,905,474 A | | 9/1975 | Haibara | |
| 4,324,357 A | * | 4/1982 | Murkowski | 206/521 |
| 4,606,460 A | * | 8/1986 | Luray | 206/583 |
| 4,852,743 A | * | 8/1989 | Ridgeway | 206/583 |
| 4,923,065 A | | 5/1990 | Ridgeway | |
| 5,056,665 A | | 10/1991 | Boecker et al. | |
| 5,071,009 A | | 12/1991 | Ridgeway | |
| 5,226,542 A | * | 7/1993 | Boecker et al. | 206/583 |
| 5,251,760 A | | 10/1993 | Smith et al. | |

(Continued)

FOREIGN PATENT DOCUMENTS

DE 202 12 344 U 10/2002

OTHER PUBLICATIONS

Korrvu® Suspension Packaging and Retention Packaging brochure, "Redefining Product Protection—See for Yourself", Sealed Air Corporation, 2000.

*Primary Examiner*—Eugene Kim
*Assistant Examiner*—Dolores R. Collins
(74) *Attorney, Agent, or Firm*—Lerner, David, Littenberg, Krumholz & Mentlik, LLP

(57) ABSTRACT

A packaging structure for holding an article within an outer container includes a frame having a main portion for receiving the article, and a pair of side legs and a pair of end legs foldably connected to the main portion for supporting the main portion. The main portion includes a series of foldable members, the foldable members in a first group being pivotable about axes extending in a first direction and the foldable members in a second group being pivotable about axes extending in a second direction different from the first direction. In one embodiment, the main portion may include a panel for supporting the article, and at least one flexible film for connecting the panel to the frame. A pair of these packaging structures may be arranged in confronting relationship within the outer container so that the article being packaged is held in place between the support panel in one packaging structure and the support panel in the other packaging structure. In another embodiment, a flexible film may be connected to the side legs of the frame such that, in an unfolded condition, there is slack between the film and the main portion of the frame. An article to be packaged is placed between the film and the main portion, and the side legs are placed in a folded condition, tensioning the film against the article. The packaging structure and the article held therein may be held in place in an outer container.

26 Claims, 18 Drawing Sheets

U.S. PATENT DOCUMENTS 5,259,507 A 11/1993 Smith
5,388,701 A * 2/1995 Ridgeway ..... 206/583
5,579,917 A 12/1996 Lofgren et al.
5,603,997 A * 2/1997 Lindgren et al. ..... 428/34.2
5,669,506 A 9/1997 Lofgren et al.
5,678,695 A 10/1997 Ridgeway et al.
5,722,541 A 3/1998 Lofgren et al.
5,823,348 A * 10/1998 Phillips et al. ..... 206/583
5,893,462 A * 4/1999 Ridgeway ..... 206/583
5,894,932 A 4/1999 Harding et al.
5,967,327 A 10/1999 Jones
5,975,307 A 11/1999 Harding et al.
6,148,590 A 11/2000 Ridgeway et al.
6,158,589 A 12/2000 Smith et al.
6,206,194 B1 3/2001 Beneroff et al.
6,302,274 B1 * 10/2001 Ridgeway ..... 206/583
6,311,843 B1 11/2001 Smith et al.
6,675,973 B1 * 1/2004 McDonald et al. ..... 206/583

* cited by examiner

SUSPENSION AND RETENTION PACKAGING STRUCTURES AND METHODS FOR FORMING SAME

BACKGROUND OF THE INVENTION

The present invention relates to packaging structures, and more particularly to packaging structures in which an article is held in place within an outer container by at least one plastic film. More particularly, the present invention is directed to improved methods for forming such packaging structures, and to the structures produced by these methods.

Protective packaging structures are often used when an article to be transported requires protection from physical shock, dust, dirt and other contaminants. For example, when shipping articles which may be relatively fragile, it is often desirable to package the article inside a box to protect the article from physical impacts to the box which may occur during loading, transit and unloading. In addition, when shipping sensitive electronic articles, such as computer components, it is often desirable to protect those components from dust and dirt. Aside from the shipping box itself, some additional structures are ordinarily needed to prevent the article from being damaged by uncontrolled movement within the box. Such additional structures have included paper or plastic dunnage, molded plastic foams and foam-filled cushions, among others.

One useful form of packaging for especially fragile articles is frequently referred to as a suspension package, examples of which are disclosed in U.S. Pat. No. 4,852,743 to Lewis H. Ridgeway and U.S. Pat. No. 5,388,701 to Devin C. Ridgeway. In suspension packaging, the article is suspended between two confronting sheets of plastic film. The film sheets are usually attached to corrugated frames which are sized to fit securely within a selected size box. The frame includes side and end legs which may be folded away from the film so as to space the film from the top or bottom of the box. The fact that the article is not in contact with any substantially rigid surfaces protects it from physical shock.

Suspension packaging as described above provides many advantages. In addition to the high degree of protection it provides the packaged articles, suspension packaging is conducive to an assembly line packaging procedure whereby an outer box can be formed, a first film/frame can be inserted into the box, the product to be packaged can be placed on the film within the box and can be accessed for any subsequent procedures, a second film/frame can be assembled over the product, and the box can be sealed closed. Despite these advantages, the need for two film/frame assemblies and the relatively high cost of the film can result in greater material costs, causing this form of packaging to be more costly than other forms of packaging. Where the product being packaged does not warrant the very high levels of protection provided by suspension packaging, the cost of the packaging is frequently not justified.

A less costly alternative to suspension packaging is frequently referred to as retention packaging. One version of retention packaging utilizes a corrugated frame including a rigid border extending around the entire periphery of a window opening, and side legs and end legs foldably connected to and supporting the border. A flexible film is connected to the underside of the border so that it extends across the window opening. An article to be packaged is placed on the film, and a series of four rigid flaps connected to the four sides of the border are folded over the article to hold the article in place against the film. In a variant of this package, disclosed in U.S. Pat. No. 5,893,562 to Devin C. Ridgeway, the rigid border is eliminated, the flexible film is connected to the folding side legs, and only two rigid flaps are foldably connected to the side legs to hold the article in place against the film. This variant provides increased structural rigidity while reducing the overall size of the package.

Since retention packaging utilizes only one film/frame assembly and less film, such packaging may provide cost savings over suspension packaging. However, because retention packaging holds an article in place between a film and one or more rigid panels, it does not provide the same degree of protection as is provided by suspension packaging. Moreover, the need to insert the article to be packaged between the rigid panel and the film makes retention packaging less conducive to assembly line procedures than suspension packaging.

In view of the foregoing, there exists a need for improved packaging structures which provide many of the advantages of both suspension packaging and retention packaging. Such improved packaging structures preferably will exhibit an efficient use of corrugated materials and better control of the amount of plastic film used. As a result of these efficiencies, such packaging structures may provide a cost saving to the end user. Furthermore, the more efficient use of materials may facilitate the disposal of these packaging structures after use.

SUMMARY OF THE INVENTION

The present invention addresses these needs.

One aspect of the present invention provides a packaging structure, including a frame including a main portion having a pair of side edges and a pair of end edges, a pair of side legs foldably connected to the side edges of the main portion, and a pair of end legs foldably connected to the end edges of the main portion. The main portion includes a series of foldable members, the foldable members in a first group being pivotable about axes extending in a first direction, and the foldable members in a second group being pivotable about axes extending in a second direction different from the first direction. The packaging structure further includes a first support panel arranged in the main portion and having a first end connected to the frame and a second end, and a first flexible film connecting the second end of the support panel to the frame. The first end of the support panel may be connected to one of the foldable members in the second group, and the first film may be connected to one of the pair of end legs and/or to the pair of side legs.

In preferred embodiments, the packaging structure may further include a second flexible film connecting the first end of the support panel to the frame. In accordance with such embodiments, the second film may be connected to one of the pair of end legs and/or to the pair of side legs.

In other preferred embodiments, the second end of the support panel is spaced from a free edge of one of the foldable members in the second group so as to define a first gap therebetween, and the first end of the support panel is spaced from a free edge of another of the foldable members in the second group so as to define a second gap therebetween. A second flexible film may connect the first end of the support panel to the frame. The first film may overlie the first gap and the second film may overlie the second gap.

In yet other embodiments, the packaging structure may further include a second support panel arranged in the main portion and having a first end connected to the frame and a second end connected to the first film. The second end of the second support panel may be spaced from the second end of the first support panel so as to define a window opening therebetween.

Another embodiment of a packaging structure in accordance with this aspect of the present invention includes a main portion having a pair of side edges and a pair of end edges; a pair of side legs foldably connected to the side edges of the main portion; and a pair of end legs foldably connected to the end edges of the main portion. The main portion may include a series of foldable members, the foldable members in a first group being pivotable about axes extending in a first direction, and the foldable members in a second group being pivotable about axes extending in a second direction different from the first direction, the series of foldable members delimiting a window opening. A flexible film may be connected to each of the foldable members so as to extend across the window opening without extending across any of the side edges and the end edges of the main portion.

Each of the packaging structures described above may be used within an outer container to provide a packaging assembly for holding an article. The packaging structure may be assembled in the container and the article to be packaged may be positioned on the packaging structure and the container closed. In preferred embodiments, two packaging structures may be assembled in the container in confronting relationship so that the article being packaged is held securely between the two packaging structures.

Yet another packaging structure in accordance with the present invention includes a frame having a main portion and a pair of side legs depending from the main portion, at least one of the side legs having a fold line dividing the side leg into a proximal side segment and a distal side segment. A first flexible web is connected to the frame so as to extend across a central region of the main portion; a second flexible web is connected to the frame so as to extend across one end of the main portion; and a third flexible web is connected to the frame so as to extend across another end of the main portion. At least one of the flexible webs is movable away from the main portion upon movement of the distal side segment to an open position and is movable toward the main portion upon movement of the distal side segment to a closed position. The packaging structure may further include a support panel arranged in the main portion and having first and second ends connected to the frame. Furthermore, the first, second and third flexible webs may be formed integrally with one another.

Packaging structures in accordance with the last description may be used within an outer container to provide a packaging assembly for holding an article. The article to be packaged may be inserted in the packaging structure, and the combination may then be inserted into the outer container, and the container closed.

Another aspect of the present invention provides a method for packaging an article in a packaging structure including a frame having a main portion and first and second side legs depending from the main portion, at least the first side leg having a fold line dividing the first side leg into a proximal side segment and a distal side segment, a first flexible web connected to the side legs so as to extend across a central region of the main portion, a second flexible web connected to the side legs so as to extend across one end of the main portion, and a third flexible web connected to the side legs so as to extend across another end of the main portion. The method includes folding the second side leg and the proximal side segment in a direction away from the flexible webs; folding the distal side segment in a direction toward the flexible webs to create slack between at least one of the flexible webs and the main portion; inserting at least a portion of the article between the at least one flexible web and another of the flexible webs; and folding the distal side segment in a direction away from the webs to a retaining position in which the at least one flexible web is tightened against the portion of the article.

An additional aspect of the present invention is the provision of blanks for forming each of the packaging structures described herein.

BRIEF DESCRIPTION OF THE DRAWINGS

A more complete appreciation of the subject matter of the present invention and the various advantages thereof can be realized by reference to the following detailed description in which reference is made to the accompanying drawings in which.

DETAILED DESCRIPTION

In the following are described multiple embodiments of the packaging structure of the present invention. In each embodiment, the packaging structure includes a structural frame and a flexible support web connected in selected regions to the frame. The frame may be formed from any substantially rigid, lightweight foldable material, such as cardboard, plastic, compressed foam, paperboard, corrugated cardboard and the like. A particularly preferred material is a single wall corrugated cardboard such as B-flute or E-flute corrugated cardboard. In accordance with techniques which are generally known in the packaging art, a single panel or blank of such material may be cut and folded according to predetermined patterns to yield frames having a desired size and structural features for a particular application.

The support web may be formed from any flexible material which can cradle and support a packaged article without damaging it, and may include netting, spandex, Lycra®, rubber and other resilient materials. Preferably, the web is formed from a transparent and elastomeric polymer film, and in preferred embodiments may be formed from polyvinyl chloride or polyurethane ester. By way of comparison, polyvinyl chloride films are generally less expensive and more transparent and may be more preferable for lightweight applications wherein a thickness of only 2–4 mils is necessary. Films made of polyurethane ester are generally more elastomeric and puncture resistant, and are therefore better suited for larger articles and articles having sharp protrusions. Polyurethane ester also is generally less sensitive to temperature changes and more tacky, which is useful for restraining the packaged article from slipping. Polyurethane ester films may be manufactured with a slip agent, however, to control excessive tackiness. It will be appreciated that a number of polymeric materials are suitable for forming the flexible film, and that such materials may be readily selected or custom designed by those of ordinary skill in the art to obtain the desired properties.

Figure 1:
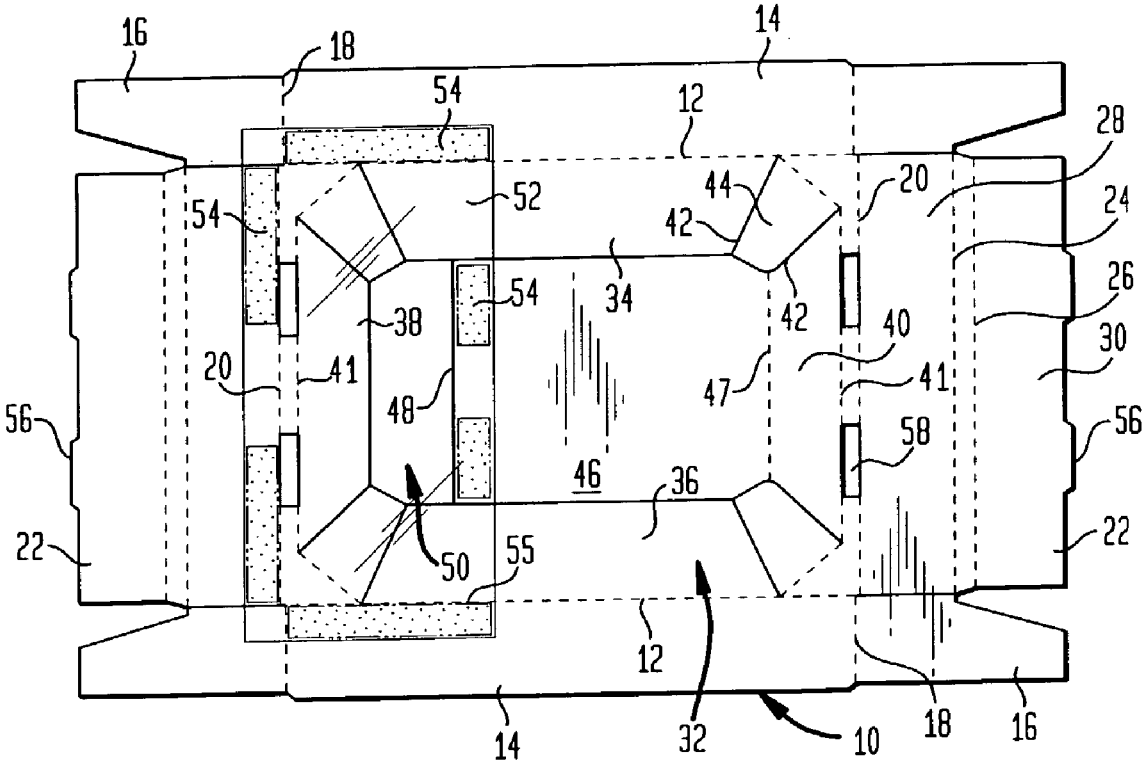
FIG. 1 is a top plan view of a blank for forming a packaging structure in accordance with one embodiment of the present invention.

Referring to the figures, a blank 10 for forming a packaging structure 11 in accordance with one embodiment of the present invention is shown in FIG. 1. Packaging structure 11 is similar to a conventional suspension form of package and, as described below, is used in much the same way. The broken lines depicted in FIG. 1, as well as in the other figures depicting blanks herein, represent lines along which the blank is creased, crimped, embossed, perforated, scored or otherwise weakened so as to be folded into the final shape of the packaging structure. The thickened bold lines represent cut lines through the entire thickness of blank 10.

Blank 10 includes a pair of longitudinal fold lines 12 which are spaced from the opposite side edges of the blank, and which thus define folding side legs 14. Side legs 14 may include extensions 16 which are foldably connected to the opposite ends of each side leg 14 along fold lines 18. The purpose of these extensions will be described more fully below in connection with the assembly and use of packaging structure 11.

Blank 10 further includes a pair of transverse fold lines 20 spaced from the opposite end edges of the blank and defining folding end legs 22. Each end leg 22 includes a pair of closely spaced intermediate fold lines 24 and 26 extending substantially parallel to transverse fold line 20 and dividing the end leg 22 into a proximal end segment 28 and a distal end segment 30. Intermediate fold lines 24 and 26 are spaced from one another by about the thickness of blank 10 so as to accommodate extensions 16 between proximal end segment 28 and distal end segment 30 in the folded condition of packaging structure 11.

Longitudinal fold lines 12 and transverse fold lines 20 collectively define a main portion of blank 10 indicated generally at 32. Main portion 32 includes a pair of foldable members 34 and 36 connected to side legs 14 in a cantilevered fashion along longitudinal fold lines 12, and a pair of foldable members 38 and 40 connected adjacent end legs 22 in a cantilevered fashion along fold lines 41 spaced from transverse fold lines 20. Adjacent foldable members may be separated from one another by a pair of cut lines, such as cut lines 42 defining a cantilevered corner member 44 therebetween, thereby enabling the foldable members to pivot independently of one another.

Main portion 32 further includes a substantially flat support panel 46 connected at one end to foldable member 40 along fold line 47 and having a free end 48 spaced from the free edge of foldable member 38 so as to define window opening 50 near one end of main portion 32. Panel 46 is separated from foldable members 34 and 36 and corner members 44 by cut lines through the entire thickness of blank 10.

A flexible film 52 is superimposed on the front surface of blank 10 so that it extends over window opening 50, longitudinal fold lines 12 and one of transverse fold lines 20. Film 52 is secured to side legs 14, one of end legs 22 and the free end of panel 46 by any suitable means, including stapling, gluing, double sided tape, hot melt adhesive, heat or ultrasonic welding and the like. In a particularly preferred arrangement, film 52 is adhered to blank 10 by a series of glue strips such as those indicated at 54. One glue strip 54 may be positioned on each of side legs 14 adjacent to longitudinal fold lines 12; a pair of glue strips 54 may be positioned on proximal end segment 28 adjacent transverse fold line 20 so that there is an unsecured region therebetween; and a further pair of glue strips 54 may be positioned adjacent the free end 48 of panel 46 so that there is an unsecured region therebetween. By controlling the positions of glue strips 54 and the size of any gaps therebetween, the creation of tension in film 52 can be controlled.

Figure 2:
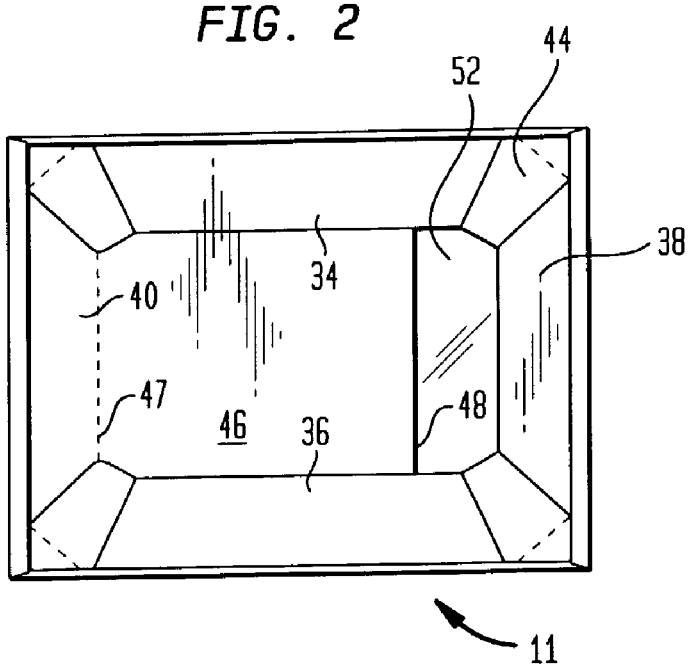
FIG. 2 is a bottom plan view of a packaging structure constructed from the blank of FIG. 1.
Figure 3:
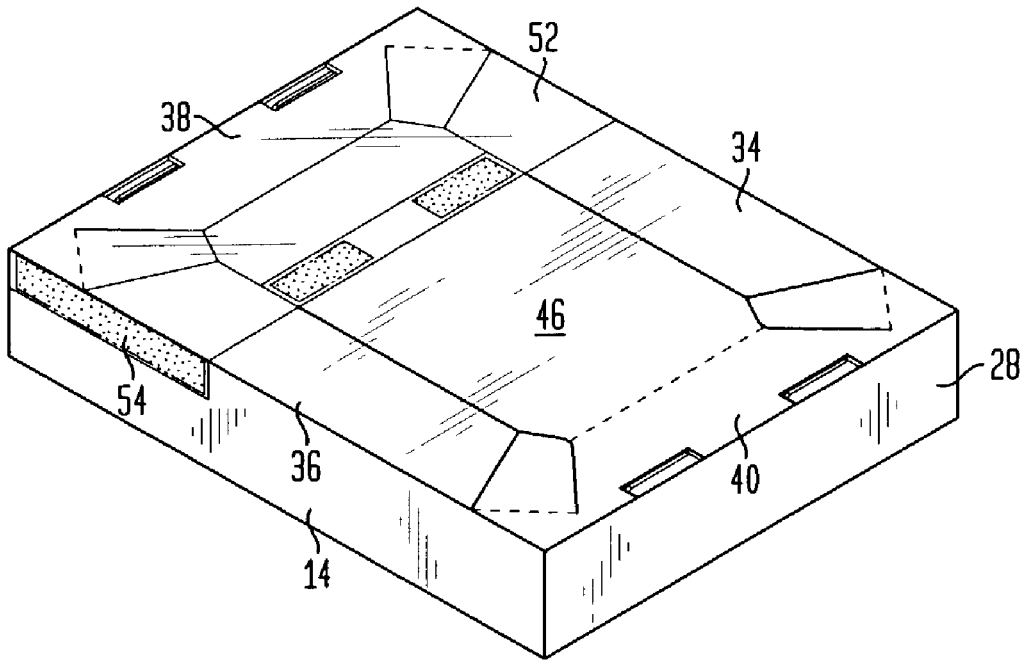
FIG. 3 is a top perspective view of the packaging structure of FIG. 2.
Figure 4:
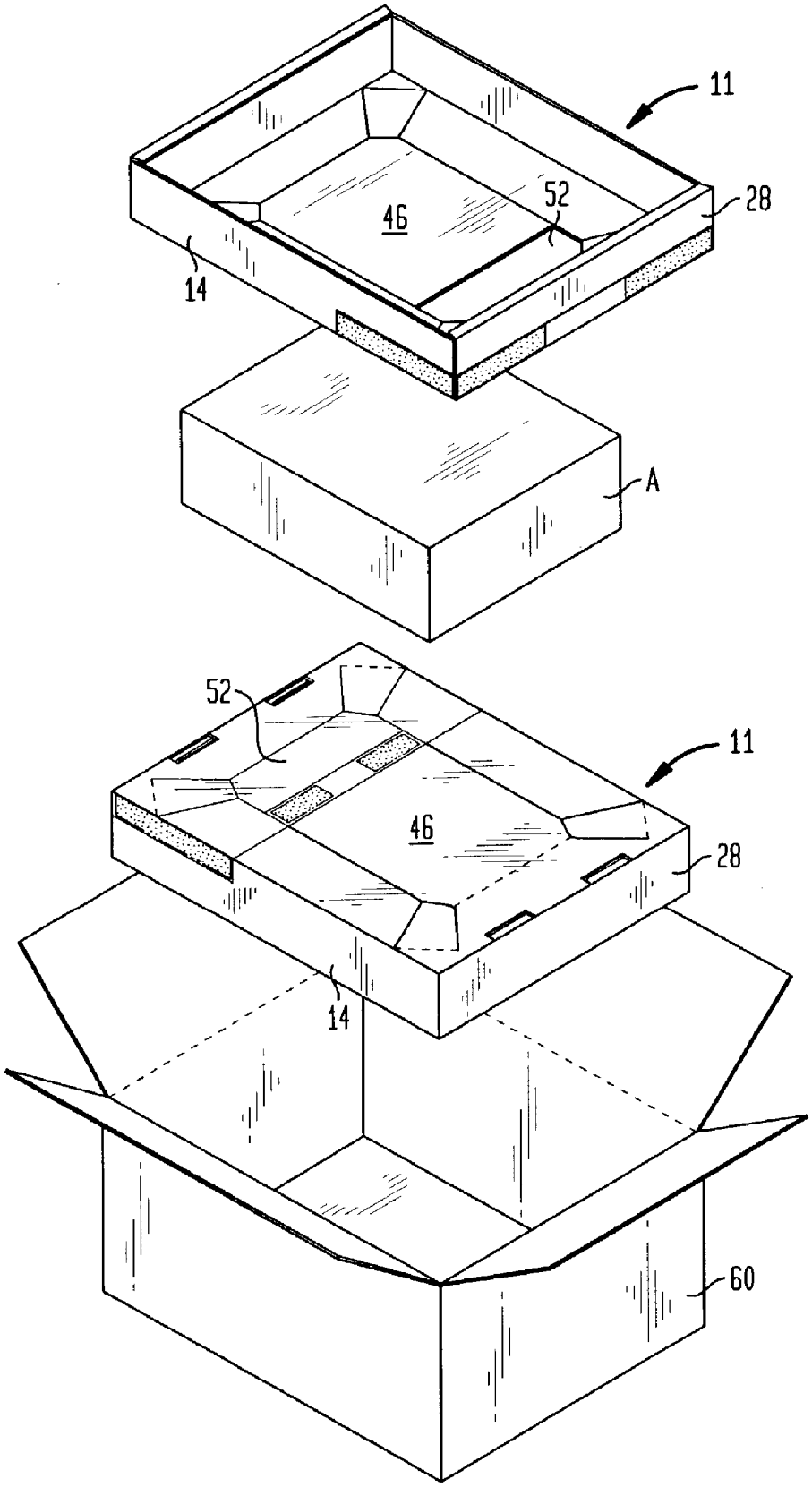
FIG. 4 is an exploded view showing the use of two of the packaging structures of FIG. 2 to package an article in an outer container.

The formation of packaging structure 11 from blank 10 and the use of packaging structure 11 to securely hold an article A in an outer container can be best understood with reference to FIGS. 2–4. With blank 10 in a face down orientation (i.e., with film 52 facing downwardly), packaging structure 11 may be placed in a folded condition by first folding side legs 14 upwardly along longitudinal fold lines 12 until they are substantially perpendicular to main portion 32. The extensions 16 on each end of side legs 14 are then folded inwardly along fold lines 18 until they are substantially perpendicular to side legs 14. Subsequently, end legs 22 are folded upwardly adjacent the outer surfaces of extensions 16 along transverse fold lines 20, and then downwardly adjacent the inner surfaces of extensions 16 along intermediate fold lines 24 and 26. End legs 22 are held in this folded position by inserting tabs 56 formed on the free edges of distal end segments 30 into respective slots 58 formed in main portion 32 adjacent transverse fold lines 20. As side legs 14 and end legs 22 are folded upwardly relative to main portion 32, the inner edges 55 of the glue strips 54 on side legs 14 pivot about the fold lines, but otherwise do not substantially move in a vertical or horizontal direction relative to the fold lines. As a result, film 52 becomes more taut as blank 10 is placed in the folded condition.

Once placed in the folded condition, packaging structure 11 may be inverted to the orientation shown in FIG. 3 and inserted into an empty container 60 having a height which is at least twice the height of the packaging structure 11 in the use condition. An article A to be packaged may then be placed on the surface of panel 46, and a second packaging structure 11 may be inserted into container 60 so that its panel 46 contacts the article. The second packaging structure 11 may be inserted in container 60 so that its film 52 lies over the film 52 of the first packaging structure. In a preferred embodiment, however, the second packaging structure 11 is inserted into container 60 so that it is oriented in a direction opposite the first packaging structure 11. In other words, if the first packaging structure is oriented in container 60 so that film 52 is toward the left side of the container, the second packaging structure would be inserted so that its film 52 is toward the right side of the container. The upper packaging structure 11 may then be pushed downwardly until it fits entirely within container 60, causing panels 46 to pivot away from one another under the tension of film 52, thereby cradling the packaged article A therebetween and holding it securely in place. With the upper packaging structure 11 entirely within container 60, the outer flaps of the container may be folded into the closed position and sealed in a conventional manner using tape, glue, staples or another well known technique to hold the container closed.

When two packaging structures 11 are holding an article in place within an outer container, the article is held between the panels 46 of the packaging structures. Since they use panels 46 rather than discarding them, and since they use less film, packaging structures 11 exhibit a more efficient use of materials than conventional suspension packages. Moreover, packaging structures 11 are conducive to assembly line packaging in the same way as conventional suspension packages.

Depending upon the article being packaged, packaging structures 11 may provide additional advantages. For example, where the article being packaged has a sharp edge or projection, such edge or projection could potentially cut or tear the film in a suspension package, thereby weakening the overall integrity of the package. However, the rigid panels 46 of packaging structure 11 are less prone to damage from such articles. Furthermore, apertures of various sizes and shapes may be die cut into panels 46 to accommodate projections from the packaged article, thereby enabling panels 46 to act as locating devices to hold the article in place.

Figure 5:
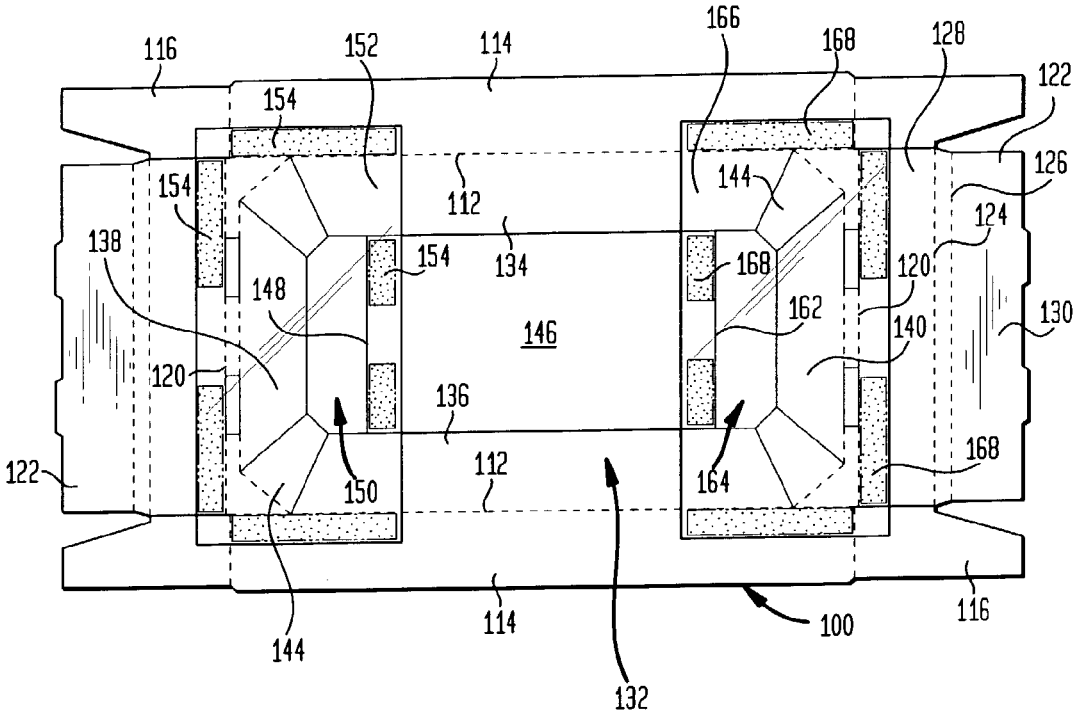
FIG. 5 is a top plan view of a blank for forming a packaging structure in accordance with a second embodiment of the present invention.

A blank 100 for forming a packaging structure 111 of a suspension type in accordance with a second embodiment of the present invention is shown in FIG. 5. Blank 100 is similar in construction to blank 10 described above, and includes folding side legs 114 having foldable extensions 116, and folding end legs 122 each having a proximal end segment 128 and a distal segment 130 separated by a pair of intermediate fold lines 124 and 126. Blank 100 also has a main portion 132 which includes foldable members 134, 136, 138 and 140 separated from one another by cantilevered corner members 144, and a substantially flat support panel 146.

Blank 100 differs from blank 10 in the manner in which panel 146 is connected to main portion 132. Rather than having one end connected to foldable member 140 as in packaging structure 11, panel 146 is free floating relative to the remainder of blank 100. Thus, one end 148 of panel 146 is spaced from the free edge of foldable member 138 so as to define window opening 150 near one end of main portion 132. Similarly, the other end 162 of panel 146 is spaced from the free end of foldable member 140 so as to define window opening 164 near the other end of main portion 132. A first flexible film 152 is superimposed on the front surface of blank 100 so that it extends over window opening 150, longitudinal fold lines 112 and one of transverse fold lines 120. Glue strips 154 or other suitable means secure film 152 to side legs 114, one of end legs 122 and the end 148 of panel 146. A second flexible film 166 is superimposed on the front surface of blank 100 so that it extends over window opening 164, longitudinal fold lines 112 and the other transverse fold line 120. Film 166 is secured by glue strips 168 or other suitable means to side legs 114, the other of end legs 122 and the end 162 of panel 146.

Figure 6:
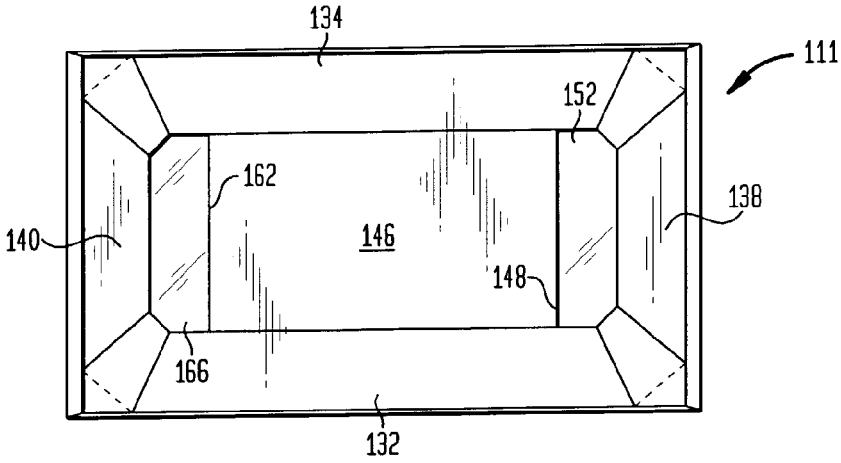
FIG. 6 is a bottom plan view of a packaging structure constructed from the blank of FIG. 5.
Figure 7:
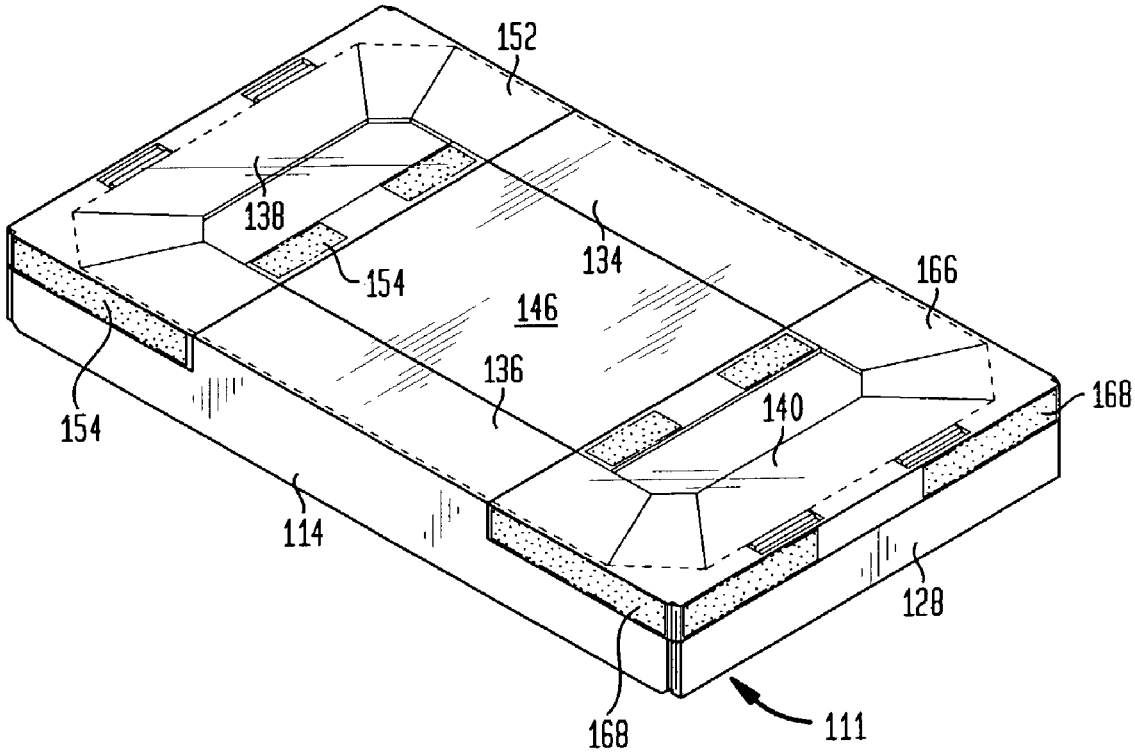
FIG. 7 is a top perspective view of the packaging structure of FIG. 6.

Blank 100 may be folded to form the packaging structure 111 shown in FIGS. 6–7 in substantially the same manner as blank 10 is folded to form packaging structure 11. Once in the folded condition, a pair of packaging structures 111 may be inserted in an outer container in the same face-to-face orientations as packaging structures 11 described above to hold an article in a suspended position therebetween.

The use of two films 152 and 166 enables packaging structure 111 to provide improved performance over packaging structure 11. That is, since panel 146 is held on each end by a film but is otherwise free floating, there is a more uniform application of pressure to an article held between a pair of these packaging structures. Hence, packaging structures 111 are particularly useful for holding elongated articles securely in place.

Figure 8:
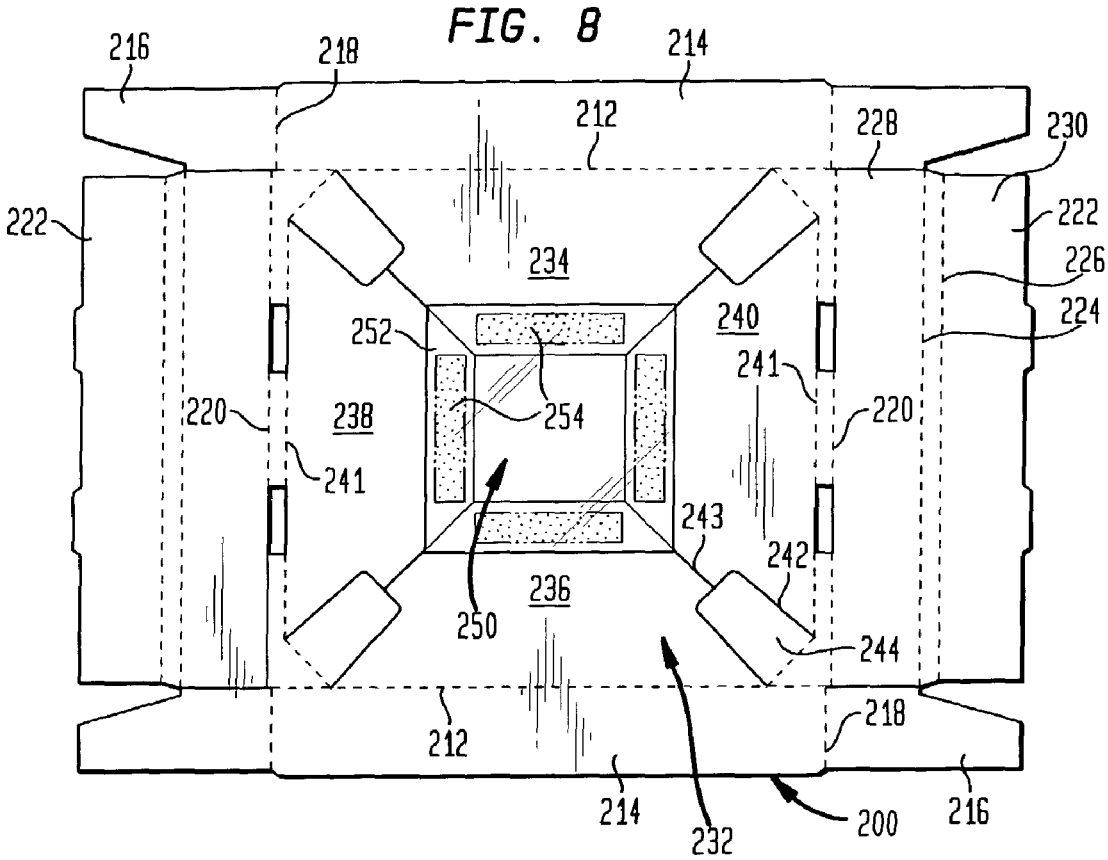
FIG. 8 is a top plan view of a blank for forming a packaging structure in accordance with a third embodiment of the present invention.

A blank 200 for forming a packaging structure 211 of a suspension type in accordance with a third embodiment of the present invention is shown in FIG. 8. Blank 200 includes a pair of longitudinal fold lines 212 spaced from the opposite side edges of the blank to define folding side legs 214. Extensions 216 may be foldably connected to the opposite ends of each side leg 214 along fold lines 218.

Blank 200 may further include a pair of transverse fold lines 220 which are spaced from opposite ends of the blank and which thus define folding end legs 222. Each end leg 222 includes a pair of closely spaced intermediate fold lines 224 and 226 extending substantially parallel to transverse fold line 220 so as to divide the end leg 222 into a proximal end segment 228 and a distal end segment 230. The distance between fold lines 224 and 226 is about the same as the thickness of blank 200 so as to accommodate extensions 216 in the folded condition of packaging structure 211.

Longitudinal fold lines 212 and transverse fold lines 220 collectively define a main portion of blank 200 indicated generally at 232. Main portion 232 includes a pair of foldable members 234 and 236 connected to side legs 214 in a cantilevered fashion along longitudinal fold lines 212, and a pair of foldable members 238 and 240 connected adjacent end legs 222 in a cantilevered fashion along fold lines 241 spaced from transverse fold lines 220. Foldable members 234, 236, 238 and 240 are wider than the corresponding foldable members in packaging structures 11 and 111 described above, thereby acting as support panels for supporting a packaged article, similar to panels 46 and 146 of these other packaging structures. Foldable members 234, 236, 238 and 240 collectively define a relatively small window opening 250 in about the center of main portion 232. Adjacent foldable members may be separated from one another by generally U-shaped cut lines 242 which define a cantilevered corner member 244 at each corner of main portion 232, and by cut lines 243 which extend diagonally from the corners of window opening 250 to the bottoms of U-shaped cut lines 242. Collectively, cut lines 242 and 243 enable the foldable members to pivot independently of one another.

A flexible film 252 is superimposed on the front surface of blank 200 so that it extends over window opening 250. Film 252 does not extend over either longitudinal fold lines 212 or transverse fold lines 220, however, but rather is secured directly to the free ends of foldable members 234, 236, 238 and 240, preferably by the use of glue strips 254. However, any suitable means may be used to join film 252 to the foldable members, including stapling, hot melt adhesive, heat or ultrasonic welding and the like.

Figure 9:
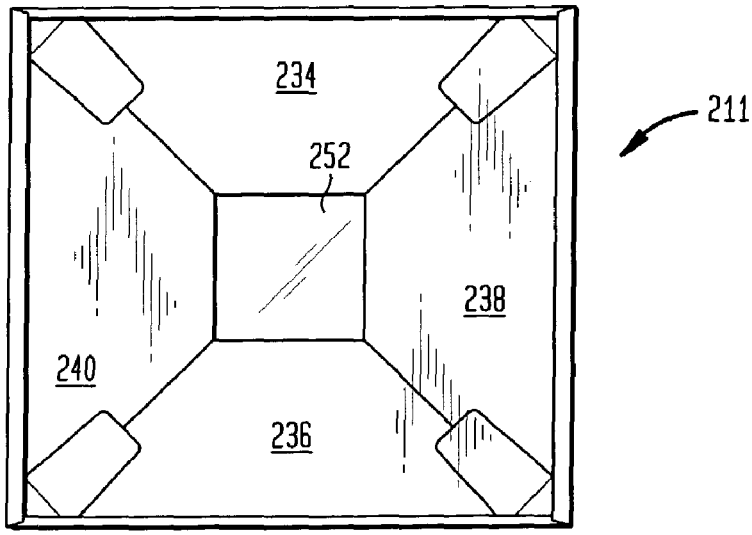
FIG. 9 is a bottom plan view of a packaging structure constructed from the blank of FIG. 8.
Figure 10:
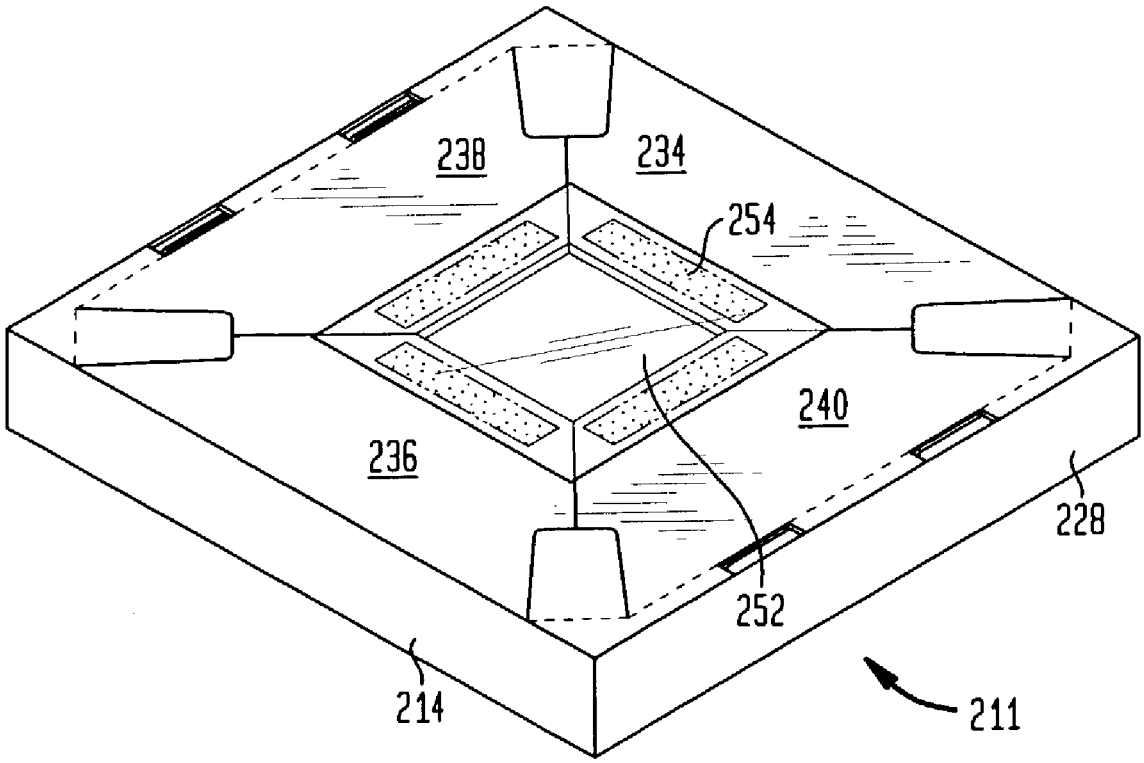
FIG. 10 is a top perspective view of the packaging structure of FIG. 9.

Blank 200 may be folded to form the packaging structure 211 shown in FIGS. 9–10 in substantially the same manner as blank 10 is folded to form packaging structure 11. A pair of folded packaging structures 211 may then be used in the same face-to-face orientation as packaging structures 11 described above to hold an article in a suspended position in an outer container. When packaging structures 211 are used to package an article, the article is supported primarily on foldable members 234, 236, 238 and 240. The flexible film 252 merely acts as a tensioning device to prevent these foldable members from collapsing downwardly under the weight of the article or should the outer container be subjected to an impact during shipment. While packaging structures 211 do not provide the same degree of protection as packaging structures 11 and 111, they are less costly to produce since they use the least amount of film, and may be used in an assembly line packaging system.

Figure 11:
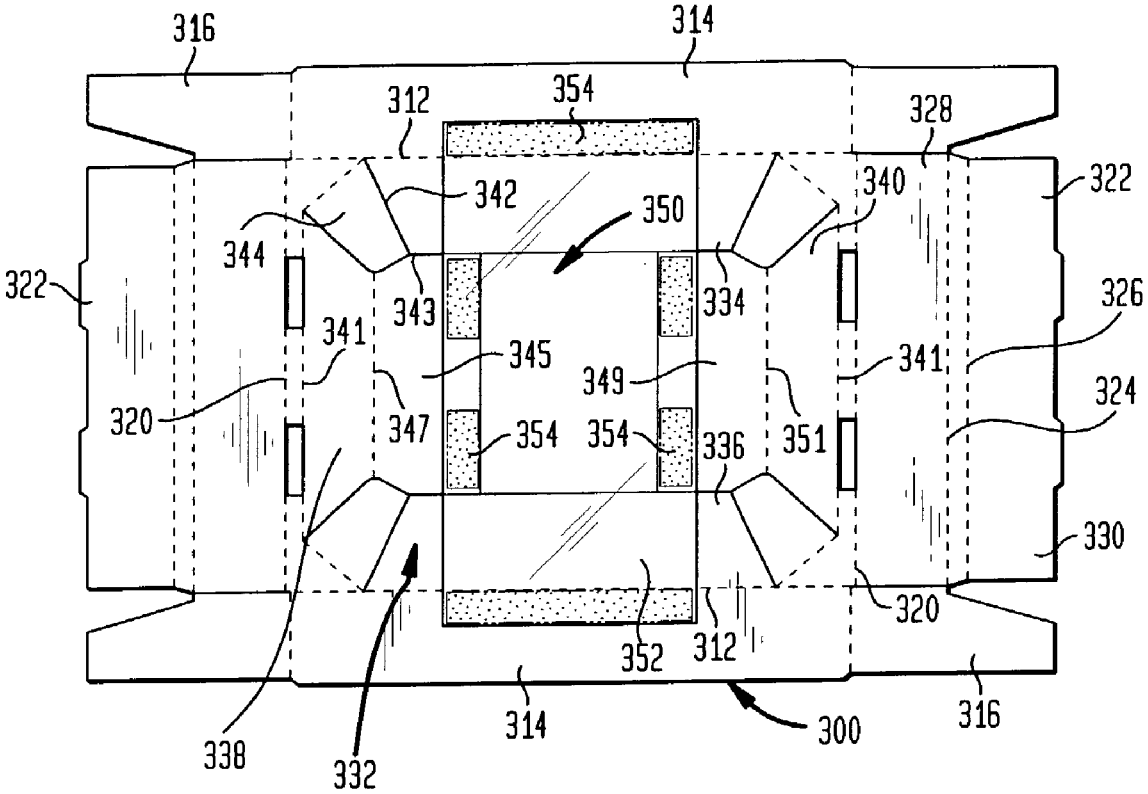
FIG. 11 is a top plan view of a blank for forming a packaging structure in accordance with a fourth embodiment of the present invention.

A blank 300 for forming a packaging structure 311 of a suspension type in accordance with a fourth embodiment of the present invention is shown in FIG. 11. Blank 300 is similar to blank 200 described above, and includes folding side legs 314 having foldable extensions 316, and folding end legs 322 each having a proximal end segment 328 and a distal end segment 330 separated by a pair of intermediate fold lines 324 and 326.

Blank 300 differs from blank 200 in the construction of main portion 332. More particularly, main portion 332 includes a pair of foldable members 334 and 336 connected to side legs 314 in a cantilevered fashion along longitudinal fold lines 312, and a pair of foldable members 338 and 340 connected adjacent end legs 322 in a cantilevered fashion along fold lines 341 spaced from transverse fold lines 320. A first support panel 345 is connected to foldable member 338 along fold line 347, and a second support panel 349 is connected to foldable member 340 along fold line 351. Collectively, foldable members 334 and 336 and support panels 343 and 347 define a window opening 350 in about the center of main portion 332. Adjacent foldable members are separated from one another and from the adjacent support panel by generally U-shaped cut lines 342 defining a corner member 344 at each corner of main portion 332, as well as by cut lines 343 which extend substantially parallel to longitudinal fold lines 312 between the corners of window opening 350 and the bottoms of U-shaped cut lines 342.

A flexible film 352 is superimposed on the front surface of blank 300 so that it extends over window opening 350, over the free ends of support panels 345 and 349, and over longitudinal fold lines 312, but not over either of transverse fold lines 320. Film 352 is secured to side legs 314 and to the free ends of panels 345 and 349, such as by glue strips 354, although any of the other attachment mechanisms mentioned above may be used.

Figure 12:
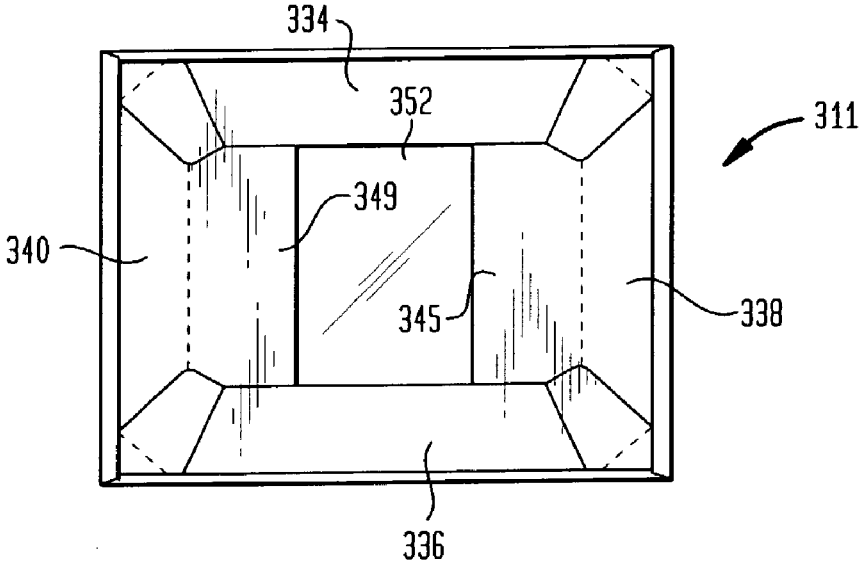
FIG. 12 is a bottom plan view of a packaging structure constructed from the blank of FIG. 11.
Figure 13:
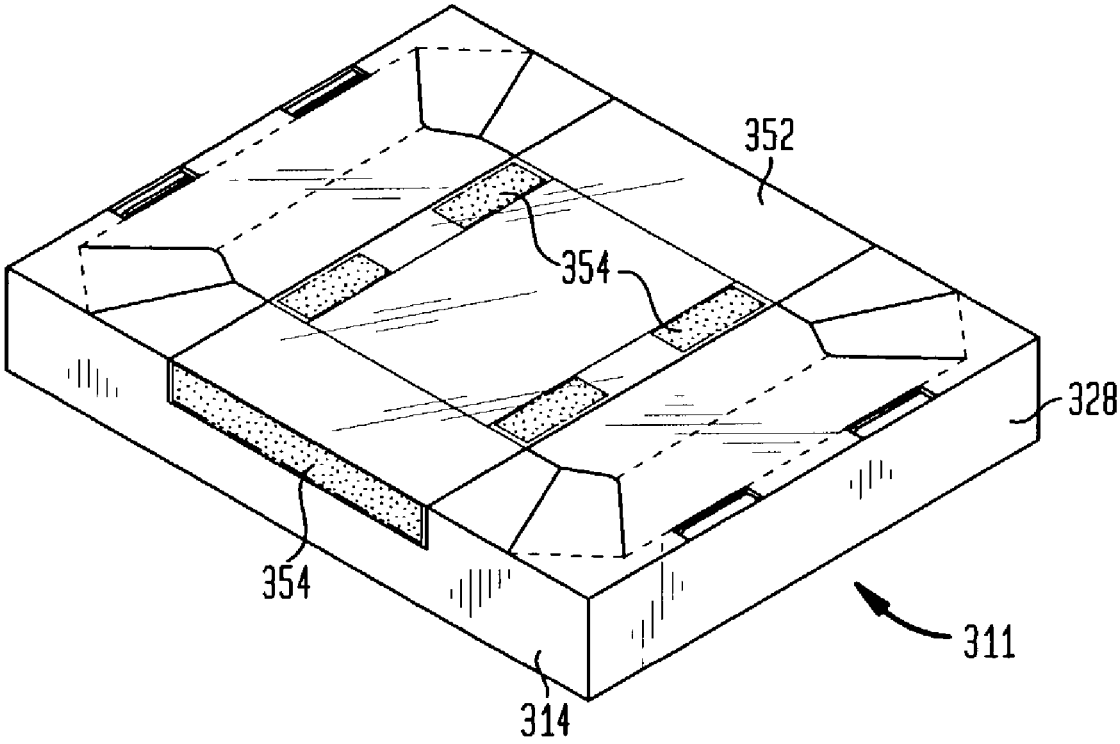
FIG. 13 is a top perspective view of the packaging structure of FIG. 12.

Blank 300 may be folded to form the packaging structure 311 shown in FIGS. 12–13 in substantially the same manner as the other blanks described above. Once in a folded condition, a pair of packaging structures 311 may be oriented in a face-to-face relationship and inserted in an outer container so as to hold an article in a suspended position therebetween. Packaging system 311 provides similar advantages to packaging structure 11 described above. However, since packaging structure 311 utilizes a greater expanse of film 352 and positions the film near the center of main portion 332, packaging structure 311 is able to flex more than packaging structure 11, and therefore is more appropriate for packaging articles which are thicker in profile or which require a greater degree of protection.

Figure 14:
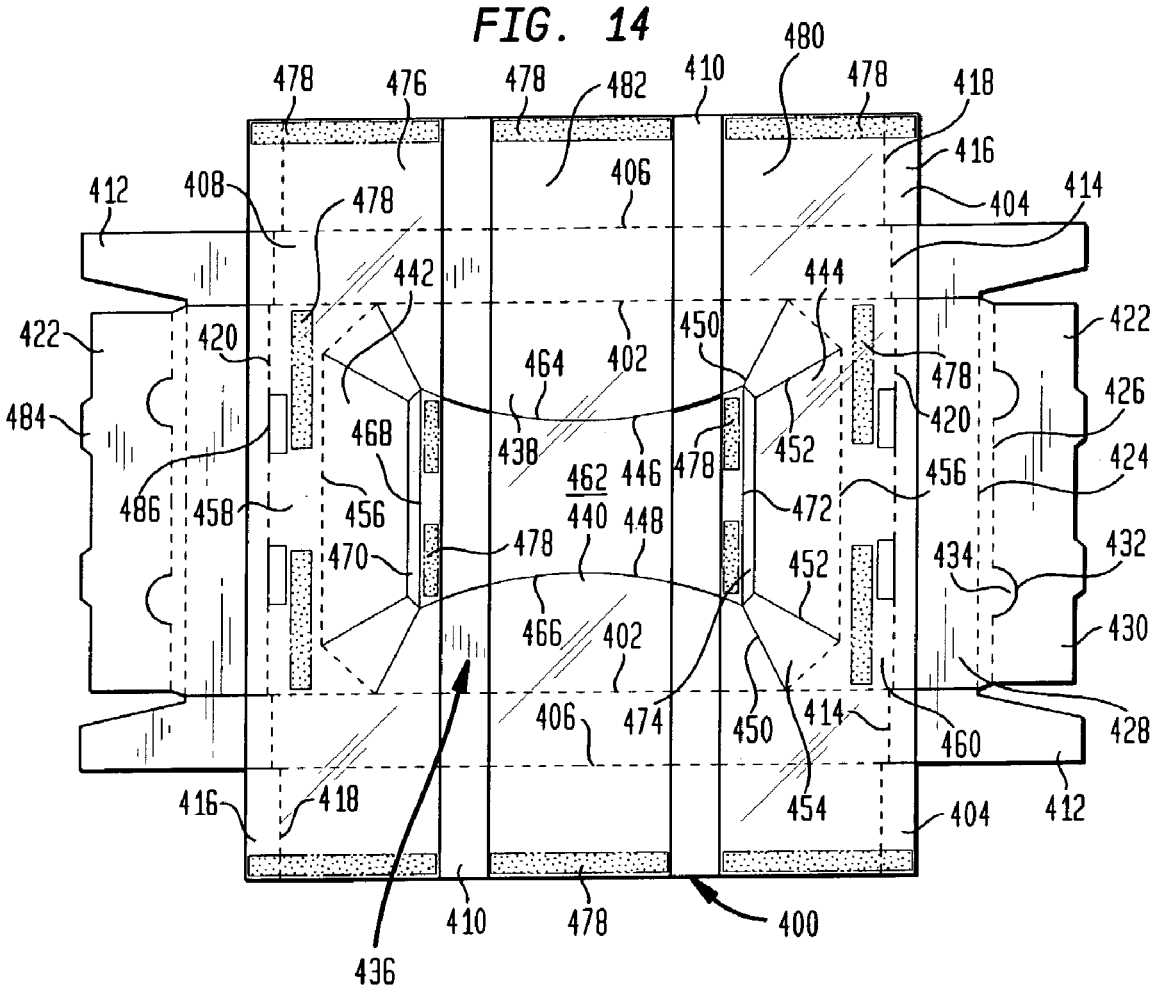
FIG. 14 is a top plan view of a blank for forming a packaging structure in accordance with a fifth embodiment of the present invention.
Figure 15:
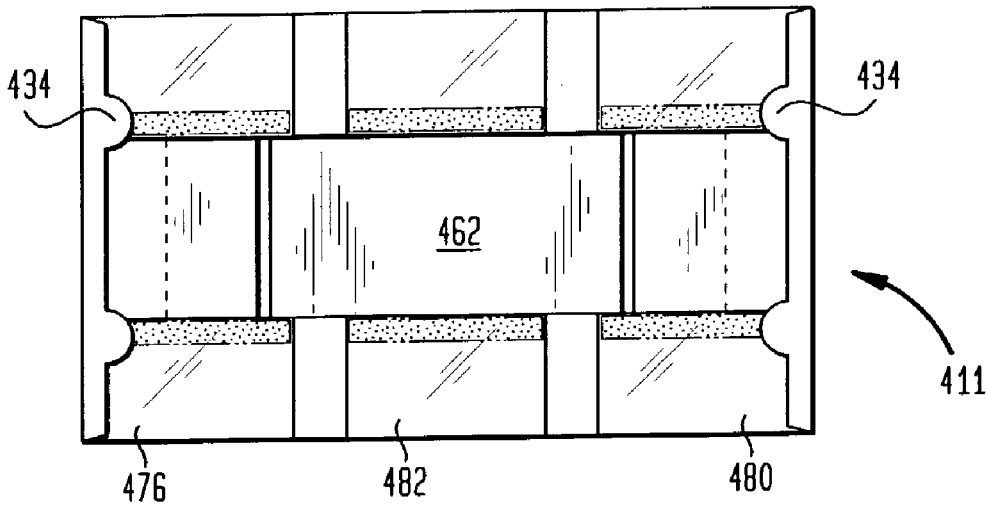
FIG. 15 is a bottom plan view of a packaging structure constructed from the blank of FIG. 14.
Figure 16:
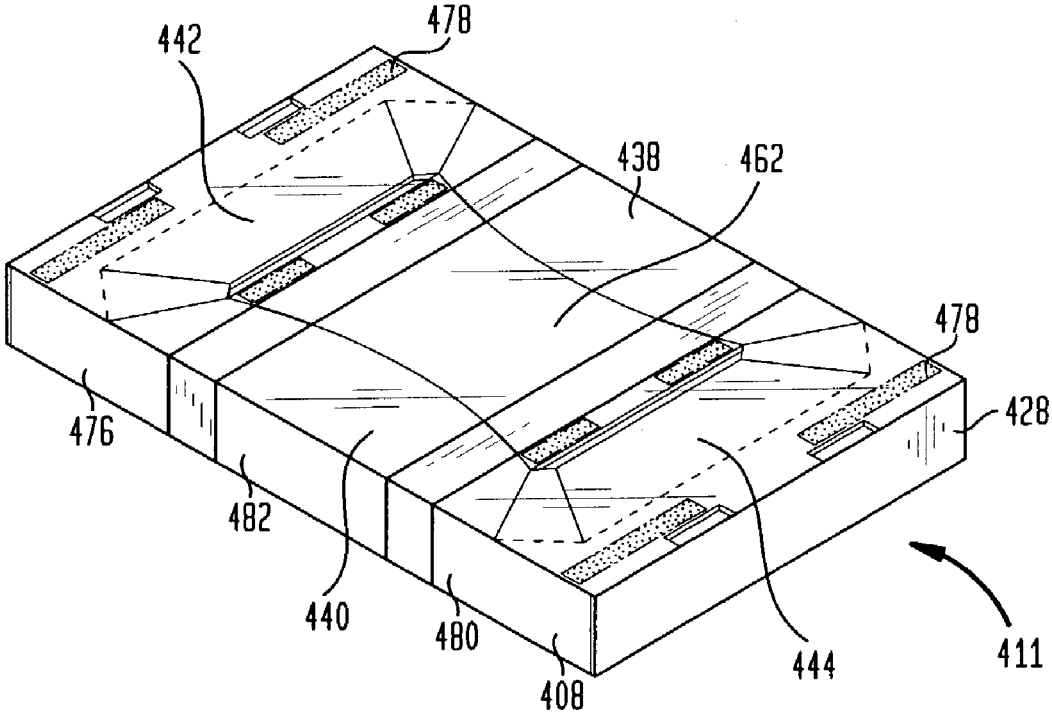
FIG. 16 is a top perspective view of the packaging structure of FIG. 15.

A blank 400 for forming a packaging structure 411 in accordance with a further embodiment of the present invention is shown in FIG. 14. In contrast to packaging structures 11, 111, 211 and 311 described above, packaging structure 411 is more akin to a conventional retention form of package and is used in essentially the same way.

Referring to FIG. 14, blank 400 includes a pair of longitudinal fold lines 402 which are spaced from the opposite side edges of the blank, and which thus define folding side legs 404. Each side leg 404 includes an intermediate fold line 406 extending substantially parallel to fold line 402 and dividing the side leg into a proximal side segment 408 and a distal side segment 410. Elongated extensions 412 may be foldably connected to the opposite ends of proximal side segments 408 along fold lines 414, and relatively short extensions 416 may be foldably connected to the opposite ends of distal side segments 410 along fold lines 418. As can be seen in FIG. 14, fold lines 418 are not linearly aligned with fold lines 414, but rather are offset inwardly thereof. The purpose of this offset will be understood from the description below of the assembly of packaging structure 411.

Blank 400 further includes a pair of transverse fold lines 420 spaced from the opposite end edges of the blank and defining folding end legs 422. Each end leg 422 includes a pair of closely spaced intermediate fold lines 424 and 426 extending substantially parallel to fold line 420 and dividing the end leg 422 into a proximal end segment 428 and a distal end segment 430. Intermediate fold lines 424 and 426 are spaced from one another by about the thickness of blank 400 so as to accommodate elongated extensions 412 between proximal end segment 428 and distal end segment 430 in the folded condition of packaging structure 411. Each end leg 422 also includes a pair of semicircular cut lines 432 formed in distal end segment 430 so as to define a pair of tabs 434 which project from intermediate fold line 426 toward the interior of packaging structure 411 when the packaging structure is in the folded condition. The purpose of tabs 434 will be understood from the description of the assembly of packaging structure 411 set forth below.

Longitudinal fold lines 402 and transverse fold lines 420 collectively define a main portion 436 of blank 400. Main portion 436 includes a pair of foldable members 438 and 440 connected to side legs 404 in a cantilevered fashion along longitudinal fold lines 402, and a pair of foldable members 442 and 444 connected adjacent end legs 422 in a cantilevered fashion along fold lines 456 spaced from transverse fold lines 420. Foldable members 438 and 440 preferably have outwardly curved free edges, as at 446 and 448, respectively. Adjacent foldable members may be separated from one another by a pair of cut lines 450 and 452 which define a cantilevered member 454 therebetween, thereby enabling the foldable members to pivot independently of one another. As shown in FIG. 14, cut lines 450 and 452 are not necessarily formed symmetrically with respect to the corners of main portion 436. Rather, the cut lines may be offset toward foldable members 438 and 440, whereby cut lines 450 terminate at longitudinal fold lines 402 and cut lines 452 terminate at a spaced distance from transverse fold lines 420. Fold lines 456 extending substantially parallel to transverse fold lines 420 between the outermost ends of cut lines 452 define weakened regions spaced from transverse fold lines 420 along which foldable members 442 and 444 may pivot. The spacing of fold lines 456 from transverse fold lines 420 creates border portions 458 and 460 at each end of main portion 436. The presence of these border portions increases the structural strength of packaging structure 411 in the use condition. Moreover, border portions 458 and 460 provide surfaces which are engageable by retaining structures formed by an outer container to hold packaging structure 411 securely in place in the outer container, all of which is discussed below.

Main portion 436 further includes a substantially flat support panel 462 positioned between the free ends of foldable members 438, 440, 442 and 444. Panel 462 includes inwardly curved longitudinal side edges 464 and 466 which are shaped to mate with the outwardly curved free edges 446 and 448 of foldable members 438 and 440, respectively. Indeed, a single die cut through blank 400 may simultaneously form free edge 446 of foldable member 438 and side edge 464 of panel 462, and another die cut through blank 400 may simultaneously form free edge 448 of foldable member 440 and side edge 466 of panel 462. Panel 462 further includes one end 468 which is spaced from the free end of foldable member 442 so as to define a gap 470 near one end of main portion 436. Similarly, the other end 472 of panel 462 is spaced from the free end of foldable member 444 so as to define a gap 474 near the other end of main portion 436. It therefore will be appreciated that panel 462 is not connected to any of foldable members 438, 440, 442 or 444, such that panel 462 is free floating relative to the remainder of blank 400.

A first flexible film 476 is superimposed on the front surface of blank 400 so that it extends over gap 470 and longitudinal fold lines 402. Glue strips 478 or other suitable means secure film 476 to distal side segments 410, border portion 458 and end 468 of panel 462. A second flexible film 480 is superimposed on the front surface of blank 400 so that it extends over gap 474 and longitudinal fold lines 402. Film 480 is secured by glue strips 478 or other suitable means to distal side segments 410, border portion 460 and end 472 of panel 462. A third flexible film 482 is superimposed on the front surface of blank 400 so that it extends over substantially the center of panel 462 and longitudinal fold lines 402. Film 482 is secured only to distal side segments 410, such as by glue strips 478 or other suitable means.

The formation of packaging structure 411 from blank 400 and the use of packaging structure 411 to securely hold an article A can be best understood with reference to FIGS. 15–18. With blank 400 in a face down orientation (i.e., with each of films 476, 480 and 482 facing downwardly), packaging structure 411 may be placed in a folded condition by first folding side legs 404 upwardly along longitudinal fold lines 402 until they are substantially perpendicular to main portion 436. The extensions 412 on each end of proximal side segments 408 are then folded inwardly along fold lines 414 until they are substantially perpendicular to side legs 404. Subsequently, end legs 422 are folded upwardly along transverse fold lines 420 to positions adjacent the outer surfaces of extensions 412, and then downwardly along intermediate fold lines 424 and 426 to positions adjacent the inner surfaces of extensions 412. End legs 422 are held in this folded position by inserting tabs 484 formed on the free ends of distal end segments 430 into respective slots 486 formed in main portion 436 adjacent transverse fold lines 420. The folding of end legs 422 over extensions 412 causes tabs 434 to project outwardly from end legs 422 toward the interior of packaging structure 411.

After end legs 422 have been placed in the folded condition, distal side segments 410 may be folded outwardly, creating slack in film 482. Slack is not created in films 476 and 480 because of their connection to blank 400 in various places within main portion 436. An article A to be packaged may then be inserted between film 482 and panel 462, preferably in a central region of main portion 436. In that regard, the outwardly curved edges of foldable members 438 and 440 are shaped to ensure that article A is supported at least in part by these foldable members, and not entirely by panel 462. This is particularly useful where article A is relatively heavy and in need of greater support, but is not in need of superior packaging protection.

With article A in place, extensions 416 on each end of distal side segments 410 may be folded inwardly along fold lines 418 until they are substantially perpendicular to side legs 404. Side legs 404 may then be folded along intermediate fold lines 406 until distal side segments 410 lie substantially parallel to main portion 436. Distal side segments 410 may then be tucked under tabs 434 so that the tabs hold side legs 404 in this folded condition. The action of folding side legs 404 along fold lines 406 causes film 482 to tighten around article A. The tension in film 482 holds article A securely in place against panel 462.

The packaging structure 411 and the article A assembled therein may be inserted into an empty container 401 having inner dimensions which correspond in width and length to the folded packaging structure. Container 401 may be any conventional outer container used for shipping products, including a conventional corrugated cardboard box. For example, container 401 may be a rectangular box having a pair of side flaps 403 foldably connected to the sides of the container along longitudinal fold lines 405, and a pair of end flaps 407 foldably connected to the ends of the container along transverse fold lines 409. Each of flaps 407 may include a series of intermediate fold lines 413, 415 and 417 arranged substantially parallel to transverse fold line 409, thereby creating in each end flap intermediate segments 419, 421 and 423 and distal segment 425. The distance between transverse fold line 409 and intermediate fold line 413 desirably is substantially equal to the distance between intermediate fold lines 415 and 417. In other words, intermediate segment 419 preferably has about the same width as intermediate segment 423. Further, the distance between intermediate fold lines 413 and 415 desirably is substantially equal to the distance between intermediate fold line 417 and the free end of end flap 407. Thus, intermediate segment 421 preferably has about the same width as distal segment 425. In any event, when packaging structure 411 is assembled in container 401, the distance between intermediate fold lines 413 and 415 is preferably substantially equal to the distance between the top of packaging structure 411 and the top of container 401.

With packaging structure 411 inserted in container 401 and article A assembled in the packaging structure, end flaps 407 may be folded inwardly along intermediate fold lines 413 and 415 and outwardly along intermediate fold line 417. The end flaps may then be folded inwardly along transverse fold lines 409 while inserting distal segment 425 between packaging structure 411 and the end wall of container 401. When assembled in this fashion, end flaps 407 form retaining structures 427 and 429 which contact border portions 458 and 460, respectively, of packaging structure 411 and occupy the space between these border portions and the top of container 401, thereby preventing the packaging structure and the article A assembled therein from moving in a vertical direction in the container. Subsequently, side flaps 403 may be folded over the tops of retaining structures 427 and 429 and sealed in a conventional manner using tape, glue, staples or other well-known techniques to hold container 401 in a closed condition.

The use of packaging structure 411 to hold article A in place within outer container 401 provides more protection than the previously available versions of retention types of packaging structures. That is, rather than folding an article against a rigid panel as in prior versions of retention packages, packaging structure 411 resiliently mounts panel 462 to main portion 436. Because panel 462 is resiliently mounted to main portion 436, it is better able to absorb forces exerted on container 401 during shipment, thereby providing a better level of protection to article A. However, since only a single packaging structure 411 is used to package an article, less material is used than the suspension-type packages discussed above. For that reason, packaging structure 411 is typically less costly than suspension types of packages. Packaging structure 411 (and all of the retention-type packaging structures described below) is not conducive to assembly line packaging since article A must be assembled within packaging structure 411 before the packaging structure can be assembled in outer container 401.

Figure 19:
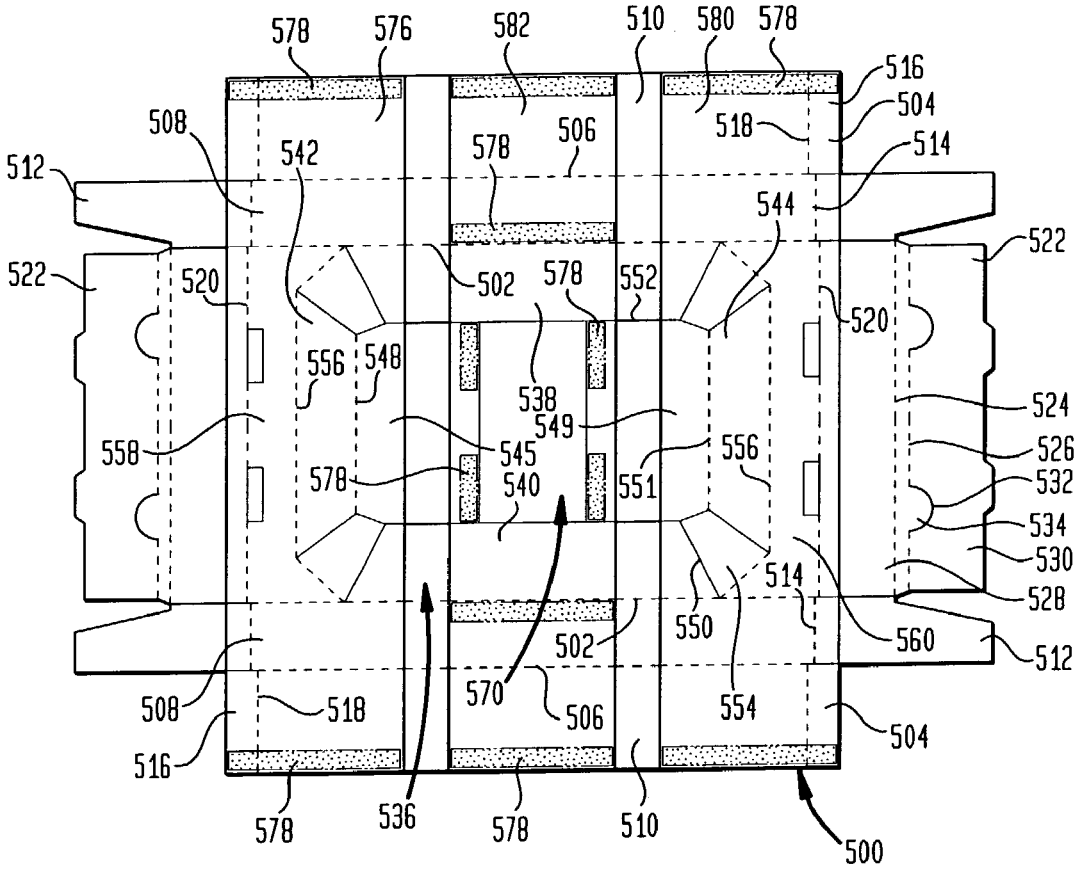
FIG. 19 is a top plan view of a blank for forming a packaging structure in accordance with a sixth embodiment of the present invention.

A blank 500 for forming a packaging structure 511 of a retention type in accordance with yet a further embodiment of the present invention is shown in FIG. 19. Blank 500 is similar in construction to blank 400 described above. Thus, blank 500 includes folding side legs 504 each having a proximal side segment 508 and a distal side segment 510 separated by an intermediate fold line 506, with elongated extensions 512 foldably connected to the opposite ends of proximal side segments 508 by fold lines 514, and relatively short extensions 516 foldably connected to the opposite ends of distal side segments 510 by fold lines 518. Blank 500 also includes folding end legs 522 each having a proximal end segment 528 and a distal end segment 530 separated by a pair of intermediate fold lines 524 and 526. A pair of semicircular cut lines 532 formed in each distal end segment 530 defines a pair of tabs 534 which project from intermediate fold line 526 toward the interior of packaging structure 511 when the packaging structure is in the folded condition.

Blank 500 differs from blank 400 in the construction of main portion 536. More particularly, main portion 536 includes a pair of foldable members 538 and 540 connected to side legs 504 in a cantilevered fashion along longitudinal fold lines 502. Preferably, the free edges of foldable members 538 and 540 are straight, rather than outwardly curved as in blank 400. Main portion 536 also includes a pair of foldable members 542 and 544 connected adjacent end legs 522 in a cantilevered fashion along fold lines 556 spaced from transverse fold lines 520. A first support panel 545 is connected to foldable member 542 along fold line 548, and a second support panel 549 is connected to foldable member 544 along fold line 551. Collectively, foldable members 538 and 540 and support panels 545 and 549 define a window opening 570 in about the center of main portion 536. Adjacent foldable members are separated from one another and from the adjacent support panel by generally U-shaped cut lines 550 defining a cantilevered member 554 adjacent each corner of main portion 536, and by cut lines 552 which extend substantially parallel to longitudinal fold lines 502 between the corners of window opening 570 and the bottoms of U-shaped cut lines 550. As with blank 400, U-shaped cut lines 550 are not necessarily formed symmetrically with respect to the corners of main portion 536, but may be offset toward foldable members 538 and 540 so that one side of a U-shaped cut line terminates at a longitudinal fold line 502 and the other side of the U-shaped cut line terminates at a spaced distance from a transverse fold line 520. Fold lines 556 extending substantially parallel to transverse fold lines 520 between the top ends of U-shaped cut lines 550 define weakened regions spaced from transverse fold lines 520 along which foldable members 542 and 544 may pivot. The spacing of fold lines 556 from transverse fold lines 520 creates border portions 558 and 560 at each end of main portion 536, thereby increasing the structural strength of the packaging structure in the use condition.

A first flexible film 576 is superimposed on the front surface of blank 500 at one end of main portion 536 and a second flexible film 580 is superimposed on the front surface of blank 500 at the opposite end of main portion 536. Films 576 and 580 extend over longitudinal fold lines 502 where they are secured to distal side segments 510, such as by glue strips 578. A third flexible film 582 is superimposed on the front surface of blank 500 so that it extends over window opening 570, over the free ends of panels 545 and 549, and over longitudinal fold lines 502. Film 582 may be secured to distal side segments 510, proximal side segments 508 and the free ends of panels 545 and 549, such as by glue strips 578.

Figure 20:
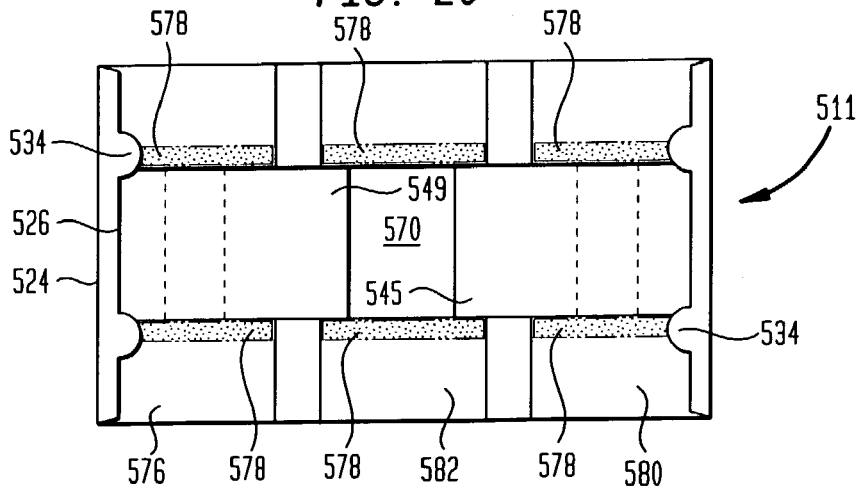
FIG. 20 is a bottom plan view of a packaging structure constructed from the blank of FIG. 19.
Figure 21:
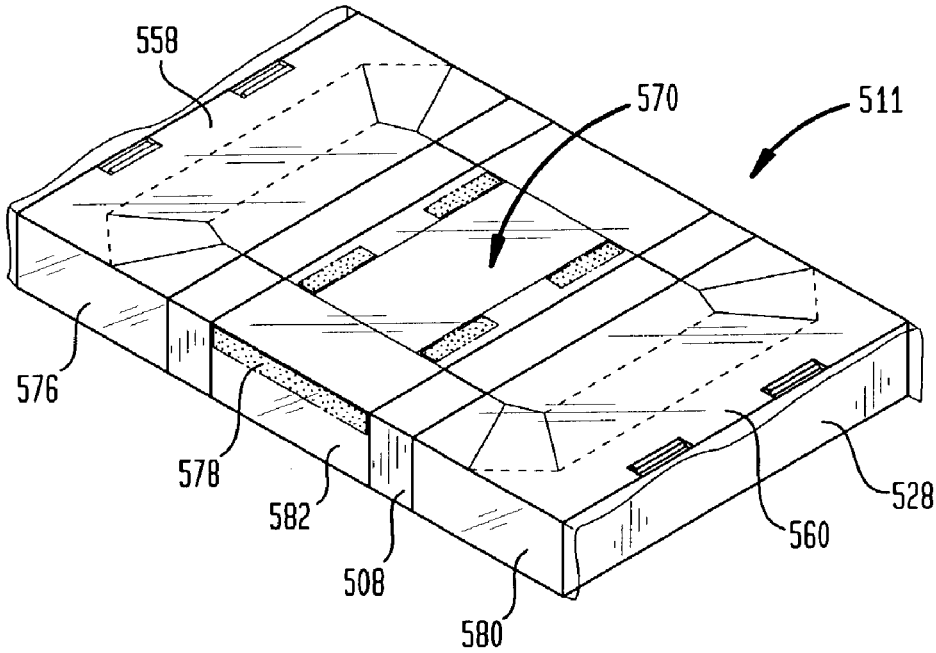
FIG. 21 is a top perspective view of the packaging structure of FIG. 20.
Figure 22:
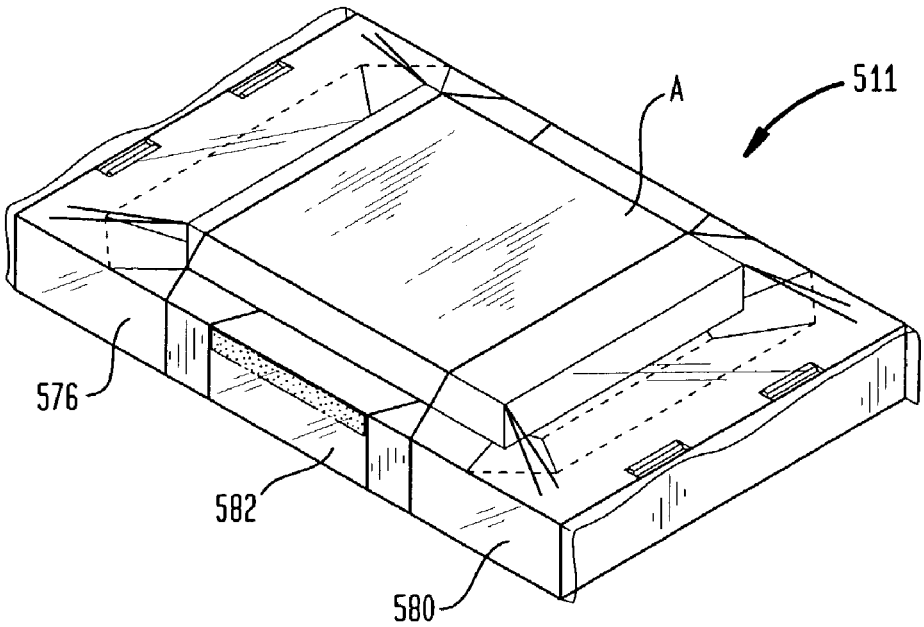
FIG. 22 is a top perspective view of the packaging structure of FIG. 20 with an article packaged therein.

Blank 500 may be folded to form the packaging structure 511 shown in FIGS. 20–22 in substantially the same manner as blank 400 is folded to form packaging structure 411. However, after end legs 522 have been placed in the folded condition, distal side segments 510 may be folded outwardly, thereby creating a significant amount of slack in films 576 and 580. No slack is created in film 582 because its attachment to proximal side segments 508 and to foldable members 542 and 544 holds the film against blank 500. With films 576 and 580 in a slackened condition, one end of an article A to be packaged may be inserted between film 576 and foldable member 542, and the other end of the article may be inserted between film 580 and foldable member 544. Subsequently, extensions 516 on each end of distal side segments 510 may be folded inwardly along fold lines 518 until they are substantially perpendicular to side legs 504.

The side legs may then be folded along intermediate fold lines 506 until distal side segments 510 lie substantially parallel to main portion 536. Distal side segments 510 may then be tucked under tabs 534 so that the tabs hold side legs 504 in this folded condition. The folding of side legs 504 along intermediate fold lines 506 causes films 576 and 580 to be pulled tightly around the ends of the article being packaged. As a result, the ends of the article are held tightly by films 576 and 580 against support panels 545 and 549.

The packaging structure 511 with the article A assembled therein may be inserted and held securely in place in an empty container, such as container 401 described above. Packaging structure 511 provides advantages similar to packaging structure 411 described above. However, since packaging structure 511 holds the ends of article A through the use of films 576 and 580, packaging structure 511 is particularly useful for holding elongated articles securely in place.

Figure 23:
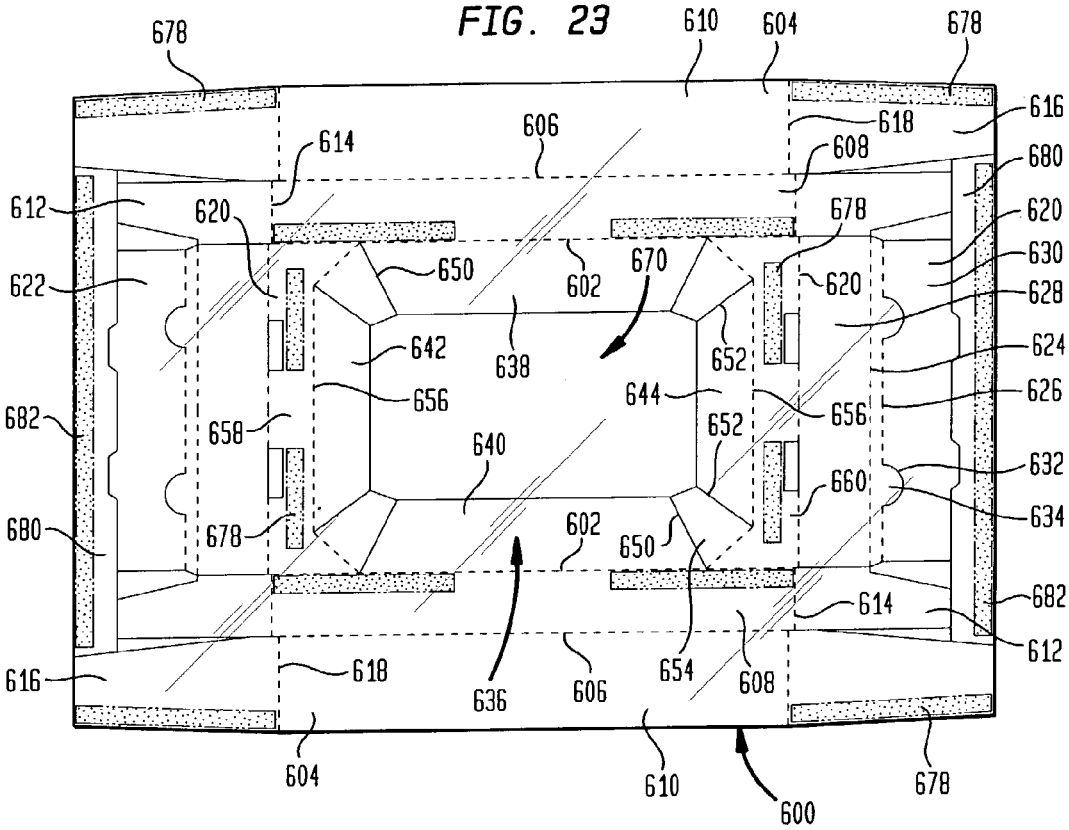
FIG. 23 is a top plan view of a blank for forming a packaging structure in accordance with a seventh embodiment of the present invention.

A blank 600 for forming a packaging structure 611 of a retention type in accordance with still a further embodiment of the present invention is shown in FIG. 23. Blank 600 includes a pair of longitudinal fold lines 602 which are spaced from the opposite side edges of the blank to define folding side legs 604. Each side leg 604 includes an intermediate fold line 606 extending substantially parallel to fold line 602 and dividing the side leg into a proximal side segment 608 and a distal side segment 610. A first pair of extensions 612 may be foldably connected to the opposite ends of proximal side segments 608 along fold lines 614, and a second pair of extensions 616 may be foldably connected to the opposite ends of distal side segments 610 along fold lines 618. As will be readily apparent from FIG. 23, extensions 616 are considerably longer than extensions 516 of blank 500 and, in fact, may be longer than extensions 612.

Blank 600 further includes a pair of transverse fold lines 620 spaced from the opposite end edges of the blank and defining fold end legs 622. Each end leg 622 includes a pair of closely spaced intermediate fold lines 624 and 626 extending substantially parallel to fold line 620 and dividing the end leg 622 into a proximal end segment 628 and a distal end segment 630. Each end leg 622 also includes a pair of semicircular cut lines 632 formed in distal end segment 630. Cut lines 632 define a pair of tabs 634 which project from intermediate fold line 626 toward the interior of packaging structure 611 when the packaging structure is in the folded condition.

Longitudinal fold lines 602 and transverse fold lines 620 collectively define a main portion 636 of blank 600. Main portion 636 is similar to main portion 436 of packaging structure 400. Thus, main portion 636 includes a pair of foldable members 638 and 640 connected to side legs 604 along longitudinal fold lines 602. However, rather than having outwardly curved free edges as in packaging structure 400, foldable members 638 and 640 preferably have straight free edges which are substantially parallel to fold lines 602. Main portion 636 also includes a pair of foldable members 642 and 644 connected adjacent end legs 622 along fold lines 656 spaced from transverse fold lines 620. Foldable members 638, 640, 642 and 644 collectively define a window opening 670 in about the center of main portion 636. Adjacent foldable members may be separated from one another by a pair of cut lines 650 and 652 which define a cantilevered member 654 therebetween. As with blank 400, cut lines 650 and cut lines 652 may be offset from the corners of main portion 636. Fold lines 656 extending substantially parallel to transverse fold lines 620 between the outermost ends of cut lines 652 define weakened regions spaced from transverse fold lines 620 along which foldable members 642 and 644 may pivot. The spacing of fold lines 656 from transverse fold lines 620 creates border portions 658 and 660 at each end of main portion 636, thereby increasing the strength of the packaging structure in the use condition.

A flexible film 676 is superimposed on the front surface of blank 600 so that it covers substantially the entirety of the blank. Glue strips 678 or other suitable means may secure film 676 to border portions 658 and 660, proximal side segments 608 and extensions 616. In addition, a strip 680, preferably formed of the material forming blank 600, may be adhered along each end of film 676 between extensions 616, such as by continuous glue strips 682.

Figure 24:
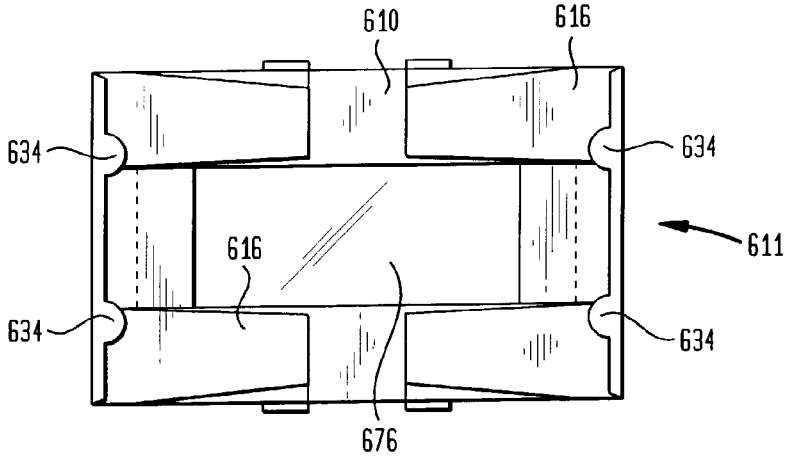
FIG. 24 is a bottom plan view of a packaging structure constructed from the blank of FIG. 23.
Figure 25:
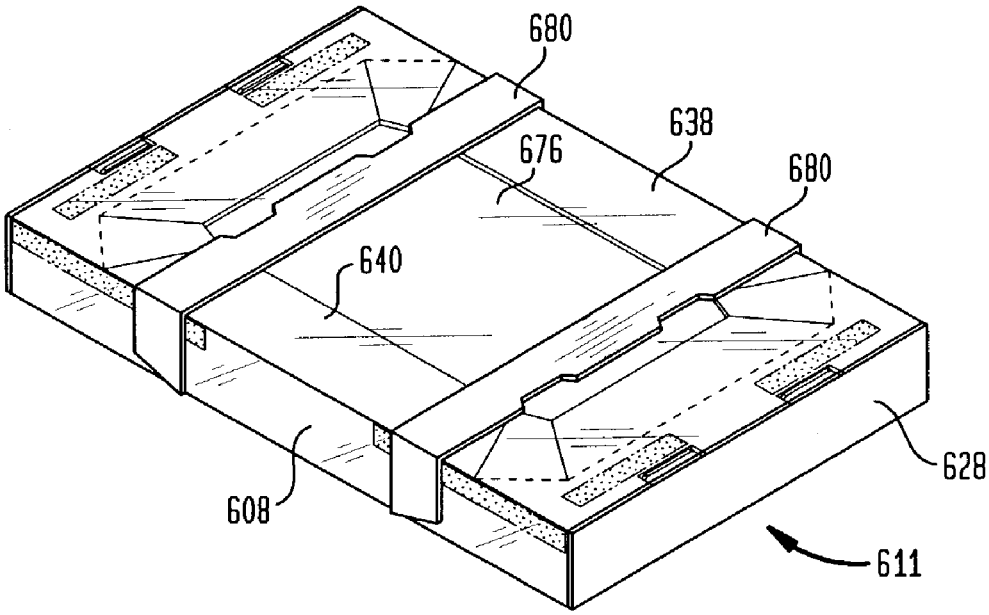
FIG. 25 is a top perspective view of the packaging structure of FIG. 24.
Figure 26:
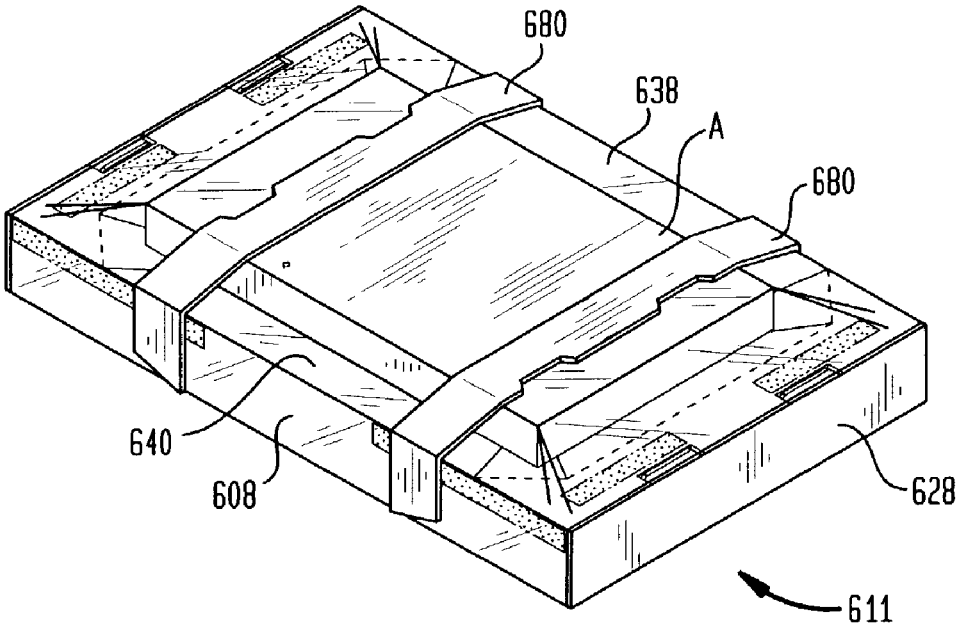
FIG. 26 is a top perspective view of the packaging structure of FIG. 24 with an article packaged therein.

Blank 600 may be folded to form the packaging structure 611 shown in FIGS. 24–26 in substantially the same manner as blank 400 is folded to form packaging structure 411. However, after end legs 622 have been placed in the folded condition, distal side segments 610 may be folded outwardly along fold lines 606. An article A to be packaged in packaging structure 611 may then be placed on film 676 at or near the center of main portion 636. As a next step, extensions 616 on each end of distal side segments 610 may be folded along fold lines 618 until the front faces of the extensions lie against the front faces of distal side segments 610. As a result of the connection of film 676 to extensions 616, this folding action causes film 676 to fold over the ends of article A at each end of main portion 636 such that strips 680 lie across the article. Where strips 680 have a length greater than the width of packaging structure 611 between fold lines 602, the connection of strips 680 to film 676 will cause the ends of the strips to fold over fold lines 602 so that the ends of the strips lie against proximal side segments 608. Subsequently, distal side segments 610 may be folded inwardly along intermediate fold lines 606 until the distal side segments lie substantially parallel to main portion 636. Distal side segments 610 and extensions 616 may then be tucked under tabs 634 so that the tabs hold the distal side segments in this folded condition.

The packaging structure 611 and the article A assembled therein may then be inserted into a container, such as container 401 described above, for shipping. Packaging structure 611 provides a degree of protection which is similar to that provided by packaging structure 511 described above. However, because strips 680 reinforce the free edges of film 676, packaging structure 611 holds article A packaged therein more securely. Hence, packaging structure 611 is particularly useful for packaging more rugged articles.

Figure 27:
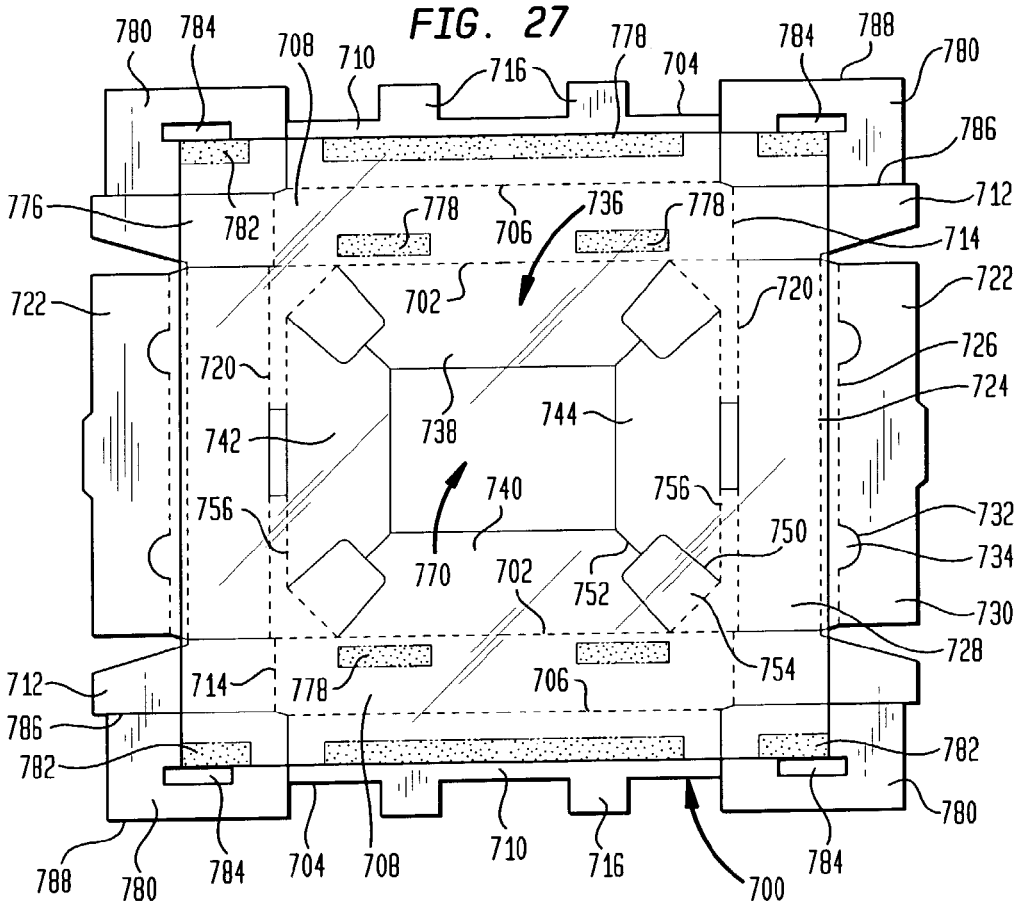
FIG. 27 is a top plan view of a blank for forming a packaging structure in accordance with an eighth embodiment of the present invention.

A blank 700 for forming a packaging structure 711 of a retention type in accordance with a still further embodiment of the present invention is shown in FIG. 27. Blank 700 is similar to blank 600 described above. In that regard, blank 700 includes folding side legs 704 each having a proximal side segment 708 and a distal side segment 710 separated by an intermediate fold line 706, with elongated extensions 712 foldably connected to the opposite ends of proximal side segments 708 by fold lines 714. The longitudinal free edge of each distal side segment 710 includes a pair of spaced tabs 716, the purpose of which will be described below. Blank 700 also includes folding end legs 722 each having a proximal end segment 728 and a distal end segment 730 separated by a pair of intermediate fold lines 724 and 726. A pair of semicircular cut lines 732 formed in each distal end segment 730 defines a pair of tabs 734 which project from intermediate fold lines 726 toward the interior of packaging structure 711 when the packaging structure is in the folded condition.

Blank 700 includes a main portion 736 which differs slightly from the main portion 636 of blank 600. Main portion 736 includes a pair of foldable members 738 and 740 connected to side legs 704 along longitudinal fold lines 702. Main portion 736 also includes a pair of foldable members 742 and 744 connected adjacent end legs 722 along fold lines 756 spaced from transverse fold lines 720. However, rather than the different widths of the foldable members in blank 500, foldable members 738, 740, 742 and 744 all extend toward the center of main portion 736 by about the same relatively large amount, thereby acting as support panels for supporting an article packaged in packaging structure 711. Collectively, foldable members 738, 740, 742 and 744 define a window opening 770 in about the center of main portion 736. Adjacent foldable members may be separated from one another by generally U-shaped cut lines 750 which define a cantilevered corner member 754 at each corner of main portion 732, and by cut lines 752 which extend diagonally from the corners of window opening 770 to the bottom of U-shaped cut lines 750. U-shaped cut lines 750 are not necessarily formed symmetrically with respect to the corners of main portion 736, but may be offset toward foldable members 738 and 740 so that one side of a U-shaped cut line terminates at a longitudinal fold line 702 and the other side of the U-shaped cut line terminates at a spaced distance from a transverse fold line 720. Fold lines 756 extending substantially parallel to transverse fold line 720 between the outer ends of U-shaped cut lines 750 define weakened regions spaced from transverse fold lines 720 along which foldable members 742 and 744 may pivot. The spacing of fold lines 756 from transverse fold lines 720 creates border portions 758 and 760 at each end of main portion 736 to increase the strength of the packaging structure in the use condition.

A flexible film 776 is superimposed on the front surface of blank 700 so that it covers substantially the entirety of the blank. Glue strips 778 or other suitable means may secure film 776 to proximal side segments 708 and distal side segments 710. In addition, separate locking members 780, preferably formed of the material forming blank 700, may be adhered to each corner of film 776, such as by glue strips 782. Each locking member 780 includes an elongated slot 784 sized to receive tabs 716 in the folded condition of packaging structure 711, as will be explained below.

Figure 28:
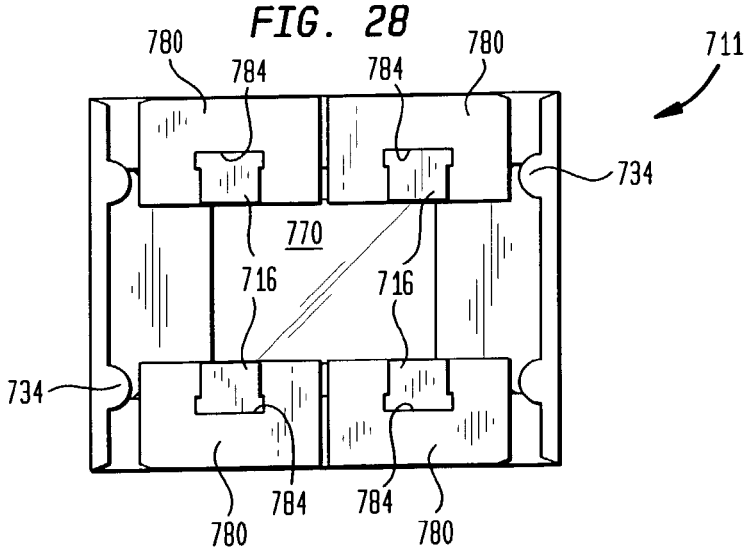
FIG. 28 is a bottom plan view of a packaging structure constructed from the blank of FIG. 27.
Figure 29:
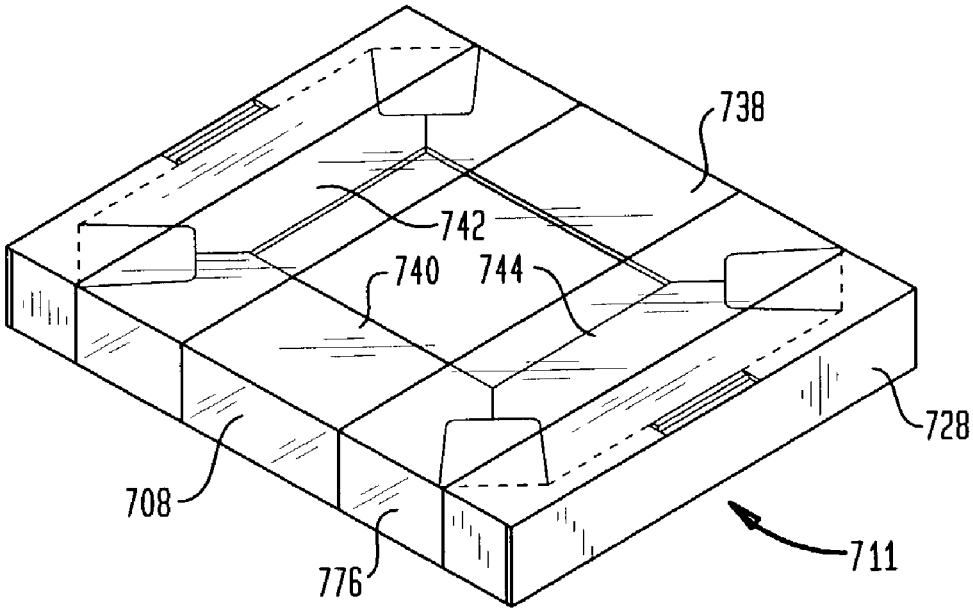
FIG. 29 is a top perspective view of the packaging structure of FIG. 28.
Figure 30:
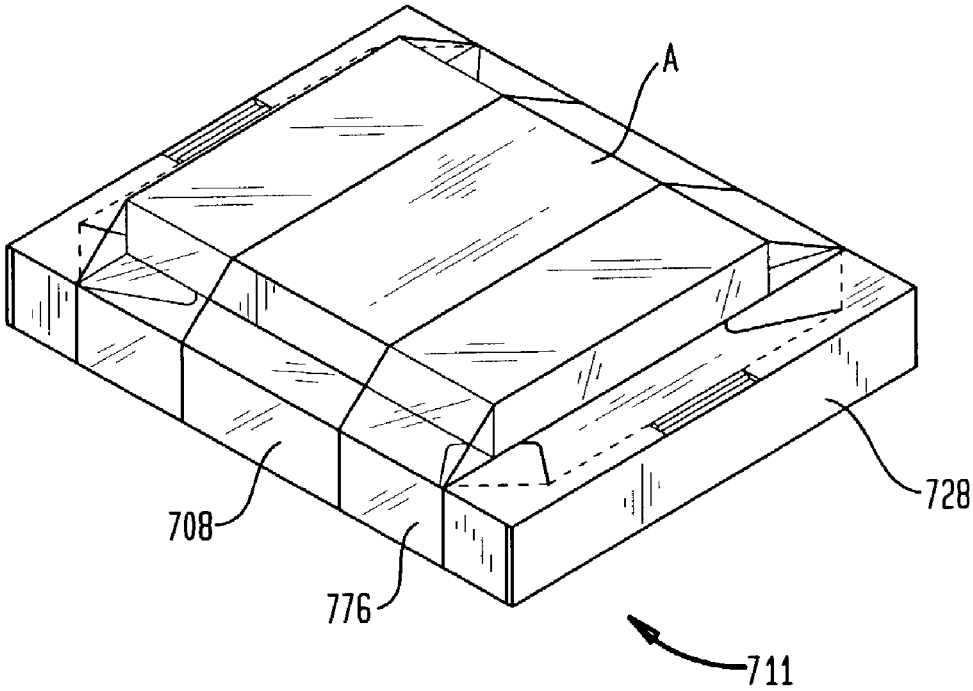
FIG. 30 is a top perspective view of the packaging structure of FIG. 28 with an article packaged therein.

Blank 700 may be folded to form the packaging structure 711 shown in FIGS. 28–30 in substantially the same manner as blank 600 is folded to form packaging structure 611. Thus, after end legs 722 have been placed in the folded condition, an article A to be packaged may be placed on film 776, preferably at or near the center of main portion 736. Subsequently, each end of film 776 may be folded back over itself until the free ends of the film lie over the ends of article A. In that regard, the positioning of glue strips 778 on proximal side segments 708 and distal side segments 710 determines how far film 776 may be pulled away from end legs 722. The folding of the ends of film 776 over the ends of article A causes locking members 780 to be positioned substantially alongside tabs 716 on side legs 704. Next, distal side segments 710 may be folded outwardly along intermediate fold lines 706, and one locking member 780 may be assembled on each of tabs 716. With all four locking members 780 assembled on the four tabs 716, distal side segments 710 may be folded inwardly along intermediate fold lines 706 until the distal side segments lie substantially parallel to main portion 736. Distal side segments 710 may then be tucked under tabs 734 so that the tabs hold the distal side segments in this folded condition.

The packaging structure 711 and the article A assembled therein may then be inserted into a container, such as container 401. Packaging structure 711 provides a similar degree of protection as packaging structure 511 described above. However, packaging structure 711 enables better control of the tension with which film 776 holds the ends of article A. More particularly, positioning slots 784 closer to the inner edges 786 of locking members 780 will cause film 776 to be pulled more tightly around article A as distal side segments 710 are folded inwardly. Conversely, if slots 784 are positioned closer to the outer edges 788 of locking members 780, film 776 will not be pulled as tightly as distal side segments 710 are folded inwardly.

In addition to the several embodiments described above, the packaging structures of the present invention may be varied in many ways. For example, it will be appreciated that, where appropriate, any of the features described in connection with a particular embodiment hereof may be incorporated in any other embodiment described herein. In one variant, the outwardly curved free edges of foldable members 438 and 440 and the inwardly curved longitudinal side edges of panel 462 in packaging structure 411 may be replaced with straight edges as in packaging structure 511. In another variant, a single film, such as film 252 of packaging structure 211, may be adhered to the free edges of foldable members having unequal widths, such as the foldable members of packaging structure 311.

Still other modifications to the packaging structures of the present invention are contemplated herein. For example, rather than having foldable members (such as foldable members 34 and 36 of packaging structure 11) connected directly to the side legs along longitudinal fold lines, the blanks for forming the packaging structures of the present invention may include an additional pair of fold lines (not shown) spaced inwardly of the longitudinal fold lines so as to create a border region between each longitudinal fold line and the adjacent foldable member. In such construction, the film or films may be secured to these border regions, rather than being secured to the side legs. Alternatively, the film or films could be connected directly to these foldable members. In a still further variant, the folding end legs (such as end legs 22 in packaging structure 11) need not have intermediate fold lines defining proximal and distal end segments. Rather, the folding end legs may each consist of a single panel foldably connected along a transverse fold line to the main portion of the packaging structure.

Figure 17:
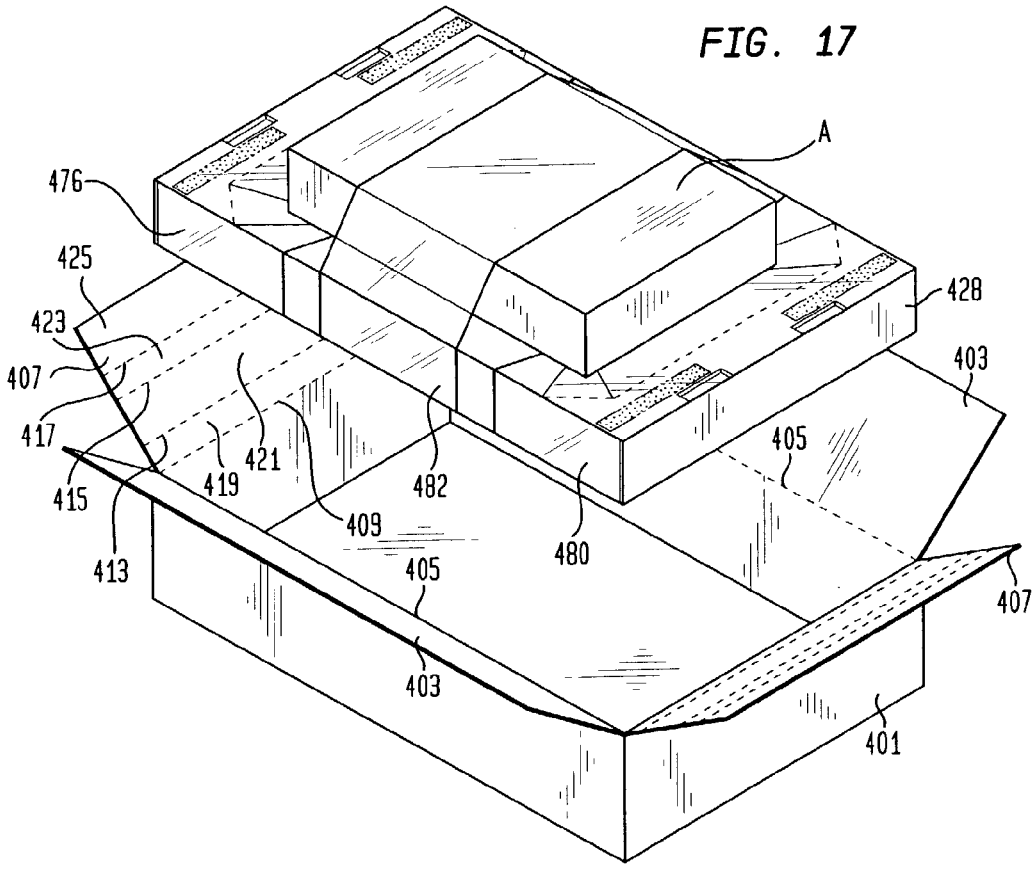
FIG. 17 is an exploded view showing the use of the packaging structure of FIG. 15 to package an article in an outer container.
Figure 18:
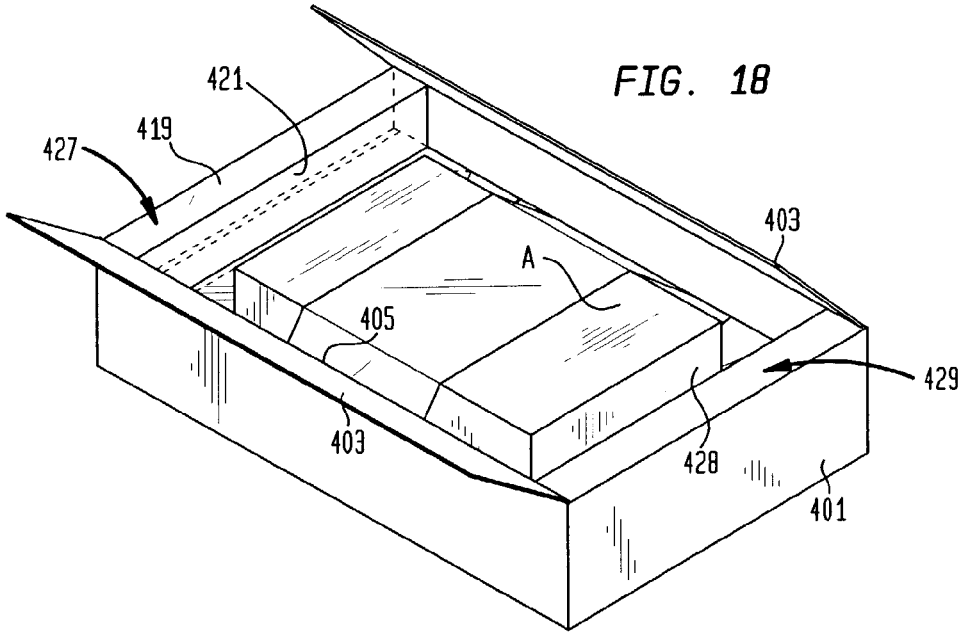
FIG. 18 is a top perspective view showing the packaging structure of FIG. 15 in an outer container with the container partially closed.

The packaging structures of the present invention may be used with any style outer container, including the standard RSC style carton shown in FIG. 4, the standard tuck end carton shown in FIG. 17, standard roll end lock front style cartons, standard roll end tuck top cartons, and other styles of slotted and die cut cartons. Furthermore, rather than being formed as a separate component for insertion into an outer container, the packaging structure may be formed integrally with the outer container.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A packaging structure, comprising:

a frame, including:

a main portion having a pair of side edges and a pair of end edges;

a pair of side legs foldably connected to said side edges of said main portion; and a pair of end legs foldably connected to said end edges of said main portion;

said main portion including a series of foldable members, said foldable members in a first group being pivotable about axes extending in a first direction, and said foldable members in a second group being pivotable about axes extending in a second direction different from said first direction;

a first support panel arranged in said main portion and having a first end connected to said frame and a second end; and a first flexible film connecting said second end of said support panel to said frame.

2. The packaging structure as claimed in claim 1, wherein said first film is connected to one of said pair of end legs.

3. The packaging structure as claimed in claim 2, wherein said first film is connected to said pair of side legs.

4. The packaging structure as claimed in claim 1, wherein said first film is connected to said pair of side legs.

5. The packaging structure as claimed in claim 1, wherein said first end of said support panel is connected to one of said foldable members in said second group.

6. The packaging structure as claimed in claim 5, wherein said support panel is formed integrally with said one of said foldable members in said second group.

7. The packaging structure as claimed in claim 1, wherein said second end of said support panel is spaced from a free edge of one of said foldable members in said second group so as to define a gap therebetween.

8. The packaging structure as claimed in claim 1, further comprising a second flexible film connecting said first end of said support panel to said frame.

9. The packaging structure as claimed in claim 8, wherein said first film is connected to one of said pair of end legs, and said second film is connected to another of said pair of end legs.

10. The packaging structure as claimed in claim 8, wherein said second film is connected to one of said pair of end legs.

11. The packaging structure as claimed in claim 8, wherein said second film is connected to said pair of side legs.

12. The packaging structure as claimed in claim 8, wherein said second end of said support panel is spaced from a free edge of one of said foldable members in said second group so as to define a first gap therebetween, and said first end of said support panel is spaced from a free edge of another of said foldable members in said second group so as to define a second gap therebetween.

13. The packaging structure as claimed in claim 10, wherein said second film is connected to said pair of side legs.

14. The packaging structure as claimed in claim 12, wherein said first film overlies said first gap and said second film overlies said gap.

15. The packaging structure as claimed in claim 1, further comprising a second support panel arranged in said main portion and having a first end connected to said frame and a second end connected to said first film.

16. The packaging structure as claimed in claim 15, wherein said second end of said second support panel is spaced from said second end of said first support panel so as to define a window opening therebetween.

17. A packaging assembly for holding an article, comprising:

a container; and at least one packaging structure assembled in said container, said packaging structure having a frame including a main portion having a pair of side edges and a pair of end edges, a pair of side legs foldably connected to said side edges of said main portion, and a pair of end legs foldably connected to said end edges of said main portion, said main portion including a series of foldable members, said foldable members in a first group being pivotable about axes extending in a first direction, and said foldable members in a second group being pivotable about axes extending in a second direction different from said first direction; a support panel arranged in said main portion and having a first end connected to said frame and a second end; and a flexible film connecting said second end of said support panel to said frame.

18. The packaging assembly as claimed in claim 17, further comprising another packaging structure assembled in said container, said another packaging structure having a frame including a main portion having a pair of side edges and a pair of end edges, a pair of side legs foldably connected to said side edges of said main portion, and a pair of end legs foldably connected to said end edges of said main portion, said main portion including a series of foldable members, said foldable members in a first group being pivotable about axes extending in a first direction, and said foldable members in a second group being pivotable about axes extending in a second direction different from said first direction; a support panel arranged in said main portion and having a first end connected to said frame and a second end; and a flexible film connecting said second end of said support panel to said frame;

said packaging structures being assembled in said container so that said main portion of said at least one packaging structure confronts said main portion of said another packaging structure.

19. A packaging structure, comprising:

a main portion having a pair of side edge and a pair of end edges;

a pair of side legs foldably connected to said side edges of said main portion;

a pair of end legs foldably connected to said end edges of said main portion;

said main portion including a series of foldable members, said foldable members in a first group being pivotable about axes extending in a first direction, and said foldable members in a second group being pivotable about axes extending in a second direction different from said first direction, said series of foldable members delimiting a window opening; and a flexible film connected to each of said foldable members so as to extend across said window opening without extending across any of said side edges and said end edges of said main portion.

20. A packaging assembly for holding an article, comprising:

a container; and at least one packaging structure assembled in said container, said packaging structure including a main portion having a pair of side edges and a pair of end edges;

a pair of side legs foldable connected to said side edges of said main portion; a pair of end legs foldably connected to said end edges of said main portion; said main portion including a series of foldable members, said foldable members in a first group being pivotable about axes extending in a first direction, and said foldable members in a second group being pivotable about axes extending in a second direction different from said first direction, said series of foldable members delimiting a window opening; and a flexible film connected to each of said foldable members so as to extend across said window opening without extending across any of said side edges and said end edges of said main portion.

21. The packaging assembly as claimed in claim 20, further comprising another packaging structure assembled in said container, said another packaging structure including a main portion having a pair of side edge and a pair of end edges; a pair of side legs foldably connected to said side edge of said main portion; a pair of end legs foldably connected to said end edges of said main portion; said main portion including a series of foldable members, said foldable members in a first group being pivotable about axes extending in a first direction, and said foldable members in a second group being pivotable about axes extending in a second direction different from said first direction, said series of foldable members delimiting a window opening; and a flexible film connected to each of said foldable members so as to extend across said window opening without extending across any of said side edges and said end edges of said main portion;

said packaging structures being assembled in said container so that said main portion of said at least one packaging structure confronts said main portion of said another packaging structure.

22. A packaging structure for holding an article, comprising:

a frame including a main portion and a pair of side legs depending from said main portion, at least one of said side legs having a fold line dividing said side leg into a proximal side segment and a distal side segment;

a first flexible web connected to said frame so as to extend across a central region of said main portion;

a second flexible web connected to said frame so as to extend across one end of said main portion; and a third flexible web connected to said frame so as to extend across another end of said main portion;

at least one of said flexible webs being movable away from said main portion upon movement of said distal side segment to an open position and being movable toward said main portion upon movement of said distal side segment to a closed position.

23. The packaging structure as claimed in claim 22, further comprising a support panel arranged in said main portion and having first and second ends connected to said frame.

24. The packaging structure as claimed in claim 22, wherein said first, second and third flexible webs are formed integrally with one another.

25. The packaging structure as claimed in claim 22, further comprising a series of foldable members, ones of said foldable members being connected to said main portion for pivoting movement about axes extending in a first direction, and others of said foldable members being connected to said main portion for pivoting movement about axes extending in a direction different from said first direction.

26. A packaging assembly for holding an article, comprising:

a container; and a packaging structure assembled in said container, said packaging structure including a frame having a main portion and a pair of side legs depending from said main portion, at least one of said side legs having a fold line dividing said side leg into a proximal side segment and a distal side segment; a first flexible web connected to said side legs so as to extend across a central region of said main portion; a second flexible web connected to said side legs so as to extend across one end of said main portion; a third flexible web connected to said side legs so as to extend across another end of said main portion; at least one of said flexible webs being movable away from said main portion upon movement of said distal side segment to an open position and being movable toward said main portion upon movement of said distal side segment to a closed portion.

* * * * *

UNITED STATES PATENT AND TRADEMARK OFFICE

CERTIFICATE OF CORRECTION

PATENT NO. : 7,086,534 B2 
APPLICATION NO. : 10/348467
DATED : August 8, 2006
INVENTOR(S) : Stephan Roesel and Christof Hammerschmidt It is certified that error appears in the above-identified patent and that said Letters Patent is hereby corrected as shown below:

Column 19, line 63, after "said" insert --second--.
Column 20, line 45, "edge" should read --edges--.
Column 21, line 1, "foldable" should read --foldably--.
Column 21, line 18, "edge" should read --edges--.
Column 21, line 20, "edge" should read --edges--.

Signed and Sealed this

Third Day of April, 2007

JON W. DUDAS
*Director of the United States Patent and Trademark Office*